US010042306B2

(12) United States Patent
Izawa et al.

(10) Patent No.: US 10,042,306 B2
(45) Date of Patent: Aug. 7, 2018

(54) ELECTRO-PHOTOGRAPHIC SHEET OF PAPER DUPLEX PRINTING MACHINE

(71) Applicant: MIYAKOSHI PRINTING MACHINERY CO., LTD., Narashino-shi, Chiba (JP)

(72) Inventors: Hideo Izawa, Harashino (JP); Kenji Takahashi, Narashino (JP); Yuuichi Yamazaki, Narashino (JP)

(73) Assignee: MIYAKOSHI PRINTING MACHINERY CO., LTD., Narashino-shi (JP)

( * ) Notice: Subject to any disclaimer, the term of this patent is extended or adjusted under 35 U.S.C. 154(b) by 0 days.

(21) Appl. No.: 15/488,075

(22) Filed: Apr. 14, 2017

(65) Prior Publication Data

US 2017/0343948 A1 Nov. 30, 2017

(30) Foreign Application Priority Data

May 27, 2016 (JP) ..... 2016-106752

(51) Int. Cl.
*G03G 15/00* (2006.01)
*G03G 15/23* (2006.01)

(52) U.S. Cl.
CPC ..... *G03G 15/657* (2013.01); *G03G 15/234* (2013.01); *G03G 15/6564* (2013.01); *G03G 15/6567* (2013.01); *G03G 2215/2083* (2013.01)

(58) Field of Classification Search
CPC ..... G03G 15/657
(Continued)

(56) References Cited

U.S. PATENT DOCUMENTS 6,438,352 B1 * 8/2002 Landa ..... G03G 15/11 101/230
7,152,528 B2 * 12/2006 Hesterman ..... B41F 7/08 101/246

(Continued)

FOREIGN PATENT DOCUMENTS

JP 2009-163064 A 7/2009
JP 2012-233999 A 11/2012

(Continued)

OTHER PUBLICATIONS

Oct. 6, 2017 Extended European Search Report issued in Application No. 17172796.9.

*Primary Examiner* — Anthony Nguyen
(74) *Attorney, Agent, or Firm* — Oliff PLC

(57) ABSTRACT

The electro-photographic sheet of paper duplex printing machine includes a sheet supply section, a sheet positioning section which positions sheets and sends out sheets to a backup roller in an electro-photographic printing section, the electro-photographic printing section transfers an image which has been transferred onto the transfer roller onto the sheet, a chain delivery section, a delivery section and a sheet carrying section for turnover. The chain delivery section selectively transfers printed sheets, which has been transferred from the backup roller to the delivery section or sheet carrying section for turnover. The sheet carrying section for turnover supplies one side printed sheet to the sheet positioning section. The sheet fed from the sheet supply section and one side printed sheet fed from the sheet carrying section for turnover are alternately carried to the sheet positioning section and the toner image on the printed sheet is fixed by the fixing device.

8 Claims, 14 Drawing Sheets

(58) Field of Classification Search
USPC ..... 399/401
See application file for complete search history.

(56) References Cited

U.S. PATENT DOCUMENTS

| | | | | |
|---|---|---|---|---|
| 8,066,282 | B2 * | 11/2011 | Muller | B65H 5/021 271/276 |
| 8,886,104 | B2 * | 11/2014 | Izawa | G03G 15/2028 399/322 |
| 9,207,618 | B2 * | 12/2015 | Izawa | G03G 15/0189 |
| 2010/0014884 | A1 | 1/2010 | Roppongi | |
| 2015/0003882 | A1 | 1/2015 | Izawa et al. | |
| 2016/0114993 | A1 * | 4/2016 | Nakagaki | G03G 15/234 271/9.05 |

FOREIGN PATENT DOCUMENTS

| | | | |
|---|---|---|---|
| JP | 2013-107760 | A | 6/2013 |
| JP | 2015-011178 | A | 1/2015 |
| WO | 2012/102381 | A1 | 8/2012 |

* cited by examiner

ELECTRO-PHOTOGRAPHIC SHEET OF PAPER DUPLEX PRINTING MACHINE

TECHNICAL FIELD

The present invention relates to an electro-photographic sheet of Paper duplex printing machine for printing both front and rear sides of a sheet of paper by an electro-photographic method.

BACKGROUND ART

An electro-photographic sheet of paper duplex printing machine for printing both sides of a sheet of paper by an electro-photographic method is heretofore disclosed in JP 2009-163064 A, JP 2013-107760 A and JP 2015-11178 A. In addition, in the following explanation, the sheet of paper will be explained simply as a sheet.

The duplex printing machine disclosed in JP 2009-163064 A and JP 2013-107760 A, comprises a sheet supply section, an electro-photographic printing section, a print sheet carrying section, a print sheet discharge section, a sheet inversing (turnover) section continued from the print sheet carrying section and performing a switchback for inversing front and back sides (up and down) of an one side printed sheet by reciprocating the sheet through a switching path, and an one side printed sheet carrying path for carrying the one side printed sheet inversed up and down to the printing section, and is configured to invert the one side printed sheet and then to carry to the printing section, then to print on its inversed side and then to carry to the print sheet discharge section as a both sides printed sheet.

The duplex printing machine disclosed in JP 2015-11178 A, comprises a sheet supply section, a sheet carrying section, an electro-photographic printing section, a sheet carrying section for inversed sheet to feed the one side printed sheet and to drop it onto the sheet carrying section, a printed sheet carrying section and a print discharge section, and is configured to inverse and carry the one side printed sheet to the printing section, then to print on its inversed side for making a both side printed sheet, then carry it to the print sheet discharge section as the both sides printed sheet through the printed sheet carrying section.

The duplex printing machine disclosed in JP 2009-163064 A and JP 2013-107760 A, the one side printed sheet is turned over by reciprocating (switching back) the sheet through a switching path and carries the one side printed sheet to the printing section, when printing the other side of the one side printed sheet.

However, in above mentioned structure in which the one side printed sheet is turned over and carried to the printing section, only one piece of the one side printed sheet at most is permitted to be in the switchback path, the following one side printed sheet cannot be sent into the switchback path until preceding one piece of the one side printed sheet passes through the switchback path.

Therefore, a carrying interval of the sheets is lengthened, as a result, the time required for print processing number of sheets per time becomes longer, resulting in a reduction of print efficiency.

The duplex printing machine disclosed in JP 2015-11178 A, the one side printed sheet is turned over by dropping the sheet during carrying it onto the sheet carrying section and carries the front and back inversed sheet to the printing section, when printing the other side of the one side printed sheet.

However, in above mentioned structure in which the one side printed sheet is turned over and then carried to the printing section, since the sheet carrying section carries alternately a prescribed number of sheets, which are sheets fed from the sheet supply section and the sheets being dropped from the sheet turnover carrying section, the sheet carrying section is needed always to continue to work for sake of efficiency of the print and so forth.

Therefore, since the one side printed sheet is dropped onto the sheet carrying section during its carrying operation when printing the other side of the one side printed sheet, register of the top and bottom of the one side printed sheet is rendered to be unstable and so the register of the top and bottom of the one side printed sheet may come out of alignment.

Besides, the one side printed sheet may be piled up on the other one side printed sheet dropped in ahead, if the space in the carrying direction between the one side printed sheets dropped onto the sheet carrying section is small, thus the space in the carrying direction between the one side printed sheets should be made wide.

In addition, the interval between the sheets of the predetermined number in the carrying direction according to a time interval from the completion of feeding of the sheets from the sheet supply section to the start of feeding of subsequent sheets should also be made wide. In other words, a time interval from the completion of feeding of a prescribed number of sheets from the sheet supply section to starting of feeding of subsequent of prescribed number of sheet from the sheet supply section should be made wide to make wide the space in the carrying direction between the prescribed number of sheets.

Therefore, the print efficiency at the time of the duplex printing is reduced.

In addition, in the duplex printing machine disclosed in JP 2015-11178 A, the printed sheet carrying section and the sheet carrying section for turnover are individually arranged and the temporary fixing devices for temporarily fixing the printed image are individually arranged at two places, therefore it has high cost and setting space becomes large.

Furthermore, the duplex printing machine disclosed in JP 2015-11178 A is configured to print the other sides of the same number of the inversed one side printed sheets after having printed one sides of the several sheets in succession and then to fix the images printed on the both side printed sheets by using the fixing device, when performing a duplex printing.

In this configuration, several both side printed sheets are successively carried to the fixing device, thereafter no sheet is carried for a certain time which is same time length as that for carrying sheets. After laps of the certain time, several both side printed sheets will be carried in succession again.

In this case, a temperature change in the fixing device at the time of printing is large, because the temperature change is repeated such that the temperature in the fixing device decreases temporarily when the both side printed sheets pass through the fixing device in succession and rises again when no both side printed sheet pass through the fixing device, and thereby difference in the quality of the product is caused.

The present invention is made to solve the problems mentioned above and seeks to provide an electro-photographic sheet of paper duplex printing machine in which a duplex printing can be efficiently performed without out of alignment of top and bottom register of the one side printed sheet at the time of a duplex printing, and its cost is small and its setting space can be small, still more, the temperature change in the fixing device at the time of printing is small and thereby the quality of the product can be stabilized.

DISCLOSURE OF THE INVENTION

The present invention provides an electro-photographic sheet of paper duplex printing machine having a sheet supply section, a sheet positioning section, an electro-photographic printing section, a chain delivery section and a delivery section arranged in order from upstream to downstream in a direction of carriage of sheets of paper, and having a sheet carrying section for turnover disposed above the sheet supply, wherein

- the sheet supply section sends out sheets one by one onto the sheet positioning section,
- the sheet positioning section positions the sheets and sends out positioned sheets to a backup roller in the electro-photographic printing section,
- the electro-photographic printing section prints a toner image on a sheet transferred onto the transfer roller onto the sheet on the backup roller by transferring the toner image,
- the chain delivery section selectively transfers printed sheets transferred from the backup roller to the delivery section or the sheet carrying section for turnover,
- the delivery section has a fixing device for fixing the toner image,
- the sheet carrying section for turnover is supplied with one side printed sheet dropped from the chain delivery section, and supplies the one side printed sheet to the sheet positioning section by a suction conveyer which is intermittently driven, and
- the sheet fed from the sheet supply section and the one side printed sheet carried from the sheet carrying section for turnover are alternately carried to the sheet positioning section, and the printed sheet passes through the fixing device in the delivery section at regular intervals.

In the electro-photographic sheet of paper duplex printing machine of the present invention, the sheet positioning section has a suction conveyer carrying the sheet at a constant speed and a pair of upper and lower registration rollers, the backup roller has a sheet support, the sheet horizontally carried by the suction conveyer in the sheet positioning section horizontally enters the pair of upper and lower registration rollers and comes to a stop when coming in contact with the contact portions of the pair of upper and lower registration rollers, and the sheet is carried to the sheet support of the backup roller by the rotation of the pair of upper and lower registration rollers.

This permits the sheet not to rebound when the sheet is positioned and thus the sheet can be accurately positioned.

In the electro-photographic sheet of paper duplex printing machine of the present invention, the suction conveyer in the sheet positioning section comprises a straight suction conveyer which is located in parallel to the carrying direction of the sheet sent out from the sheet supply section and an inclined suction conveyer which is located at an inclination with respect to the carrying direction of the sheet, and air suction power of the inclined suction conveyer is stronger than air suction power of the straight suction conveyer.

This permits the sheet to be positioned in the direction orthogonal to the carrying direction.

In the electro-photographic sheet of paper duplex printing machine of the present invention, a drop auxiliary means to apply a downward force to the sheet when making the sheet drop is installed at the sheet dropping position where the sheet is dropped from the chain delivery section to the sheet carrying section for turnover, and

- the sheet carrying section for turnover has a means to move the printed sheet in the direction orthogonal to the carrying direction.

This permits a stable dropping of the sheet onto the sheet carrying section for turnover.

According to the electro-photographic sheet of paper duplex printing machine of the present invention, a duplex printing can be efficiently performed, and there is no out of alignment of top and bottom register of the one side printed sheet at the time of a duplex printing, and its cost is small and its setting space can be small, still more, the temperature change in the fixing device at the time of printing is small, and thereby the quality of the product can be stabilized.

PREFERRED EMBODIMENT OF THE INVENTION

An embodiment of the electro-photographic sheet of paper duplex printing machine of this invention will be explained based on the drawings.

Figure 1:
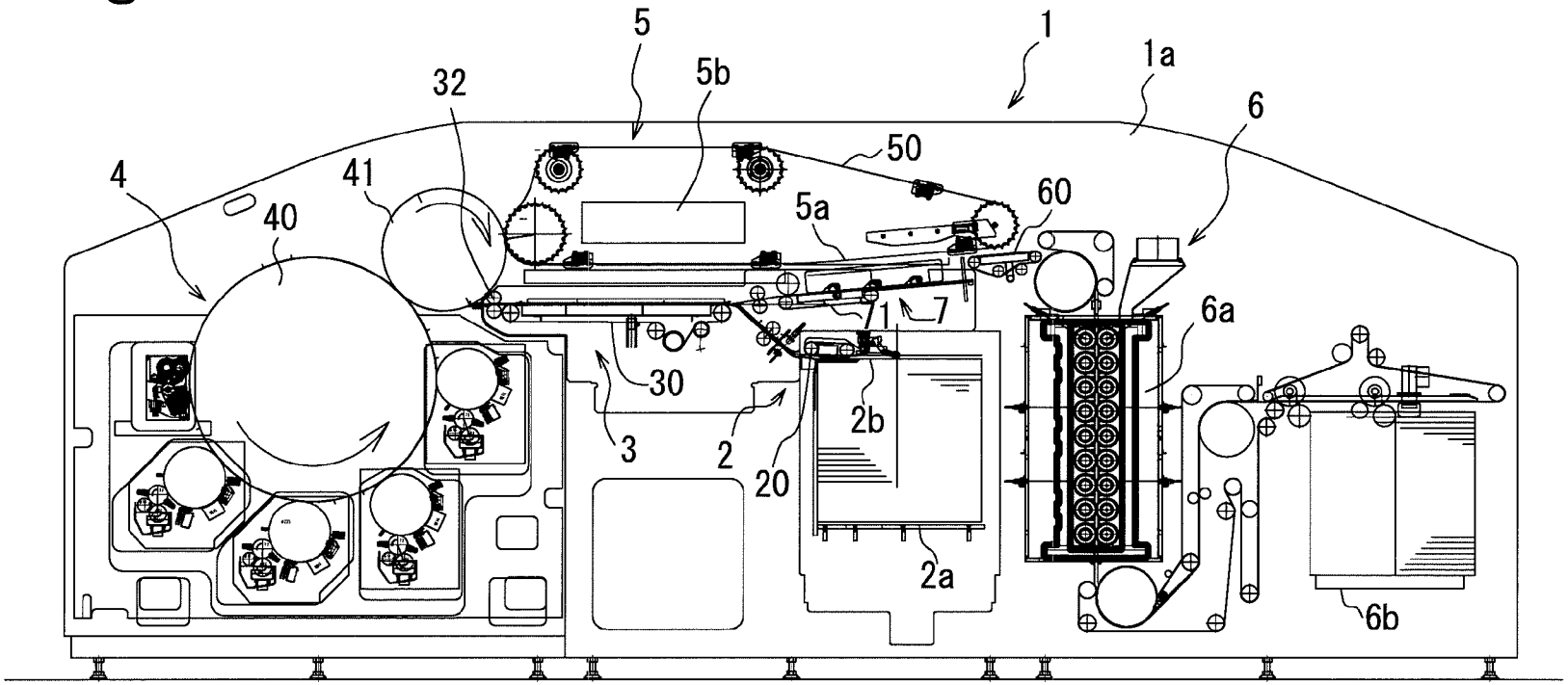
FIG. 1 is an overall structure explanatory view that illustrates an electro-photographic sheet of paper duplex printing machine of the present invention.

FIG. 1 is an overall structure explanatory view illustrating the electro-photographic sheet of paper dual printing machine.

As shown in FIG. 1, the electro-photographic sheet of paper dual printing machine 1 is provided with a sheet supply section 2, a sheet positioning section 3, an electro-photographic printing section 4, a chain delivery section 5, a delivery section 6 and a sheet carrying section for turnover 7, provided in order from upstream to downstream in the direction of carrying of sheets.

The sheet supply section 2 feeds sheets 2*b* loaded on an elevating table 2*a* one by one sequentially from the top and sends out the sheets 2*b* to a sheet positioning section 3 one by one. The sheet 2*b* is a sheet of paper.

The sheet positioning section 3 positions the sheet 2*b* sent out from the sheet supply section 2 and sends out the positioned sheet 2*b* to the electro-photographic printing section 4.

The electro-photographic printing section 4 is provided with a transfer roller 40 and a backup roller 41, and prints a toner image on the sheet 2*b* by transferring the toner image transferred onto the surface of the transfer roller 40 to the sheet 2*b* which is sent into from the positioning section 3, on backup roller 41. The printed sheet 2*b* on which the toner image is printed is carried to the chain delivery section 5 with the backup roller 41.

The chain delivery section 5 carries a printed sheet 2*b* on which the toner image is printed to the delivery section 6 with the printed side up. The chain delivery section 5 can be changed in its state to a first state in which the printed sheet 2*b* is carried up to the delivery section 6 and a second state in which the printed sheet 2*b* is dropped onto a sheet dropping position 5*a*. In other words, the printed sheet 2*b* is selectively carried to the delivery section 6 or the sheet carrying section for turnover 7.

The chain delivery section 5 is provided with a temporary fixing device 5*b* at the upstream side in the carrying direction than the sheet dropping position 5*a*.

The delivery section 6 is provided with a fixing device 6*a* to fix the image on the printed sheet 2*b* and an elevating table 6*b*, and fixes the image on the carried printed sheet 2*b* with the fixing device 6*a* and thereafter stores the printed sheet 2*b* by piling up the sheet on the elevating table 6*b*.

The sheet carrying section for turnover 7 is disposed at a position below the sheet dropping position 5*a* of the chain delivery section 5, and is located above the sheet supply section 2. The sheet carrying section for turnover 7 carries the printed sheet 2*b* dropped from the chain delivery section 5, to the sheet positioning section 3 again.

Then, the duplex printing operation to print on one side and the other side of the sheet 2*b* will be explained.

The sheet supply section 2 sends out the sheet 2*b* to the sheet positioning section 3 intermittently. In other words, the sheet supply section 2 sends out the sheet 2*b* intermittently so that the sheet 2*b* from the sheet supply section 2 and the sheet 2*b* from the sheet carrying section for turnover 7 are alternately sent to the sheet positioning section 3. The sheet positioning section 3 positions the sheet 2*b* and sends out the positioned sheet 2*b* to the backup roller 41.

The backup roller 41 holds a front end portion (the downstream side portion in the carrying direction.) of the sheet 2*b* on its peripheral surface and sends the sheet 2*b* to the surface of the transfer roller 40 by its rotation. A toner image is formed on the surface of transfer roller 40, and the toner image is transferred to one side of the sheet 2*b* on the backup roller 41, so that the toner image is printed.

The one side printed sheet 2*b* printed on its one side is sent to the chain delivery section 5 with the backup roller 41 and is then delivered to the chain delivery section 5.

The chain delivery section 5 carries the one side printed sheet 2*b* with the printed one side up, and temporarily fixes the toner image of the one side printed sheet 2*b* in the temporary fixing device 5*b*, and thereafter drops the one side printed sheet 2*b* on the sheet carrying section for turnover 7 at the sheet dropping position 5*a*. At that time, the sheet carrying section for turnover 7 is at a standstill. In other words, the chain delivery section 5 is then in the second state.

The one side printed sheet 2*b* dropped on the sheet carrying section for turnover 7 has the non-printed other side down.

Thereafter, the sheet carrying section for turnover 7 is driven to carry the one side printed sheet 2*b* to the sheet positioning section 3 with the non-printed other side down.

The sheet supply section 2 and the sheet carrying section for turnover 7 are so structured as to send the sheet 2*b* and the one side printed sheet 2*b* into the sheet positioning section 3 alternately.

The sheet positioning section 3 positions the one side printed sheet 2*b* and sends out the sheet to the backup roller 41.

A toner image is printed on the sheet 2*b* by transferring the toner image formed on the surface of the transfer roller 40 to the other side of the one side printed sheet 2*b* on backup roller 41.

Both side printed sheet 2*b* printed on its one side and the other side is sent to the chain delivery section 5 with the backup roller 41 and is then delivered to the chain delivery section 5.

The chain delivery section 5 carries the both side printed sheet 2*b* with the printed other side up, and temporarily fixes the toner image in the temporary fixing device 5*b*, and thereafter carries the sheet to the delivery section 6. That is, the chain delivery section 5 is then in the first state.

The toner image of the both side printed sheet 2*b* carried into the delivery section 6 is fixed with the fixing device 6*a* and is thereafter loaded on the elevating table 6*b* and stored.

At the time of the one side printing operation to print on only one side of the sheet 2*b*, the chain delivery section 5 should only be always in the first state and carries the one side printed sheet 2*b* to the delivery section 6.

In this way, according to the embodiment, since the one side printed sheet 2*b* is dropped onto the sheet carrying section for turnover 7 being at a standstill and is then carried to the sheet positioning section 3 by driving the sheet carrying section for turnover 7 as described above, the interval of the sheets 2*b* in the carrying direction can be shortened by sending the one side printed sheet 2*b* into the sheet positioning section 3 quickly. Besides, the top and bottom register of the one side printed sheet 2*b* dropped onto the sheet carrying section for turnover 7 is stabilized and the interval of the sheet 2*b* in the carrying direction can be shortened.

As described above, since the sheet supply section 2 and the sheet carrying section for turnover 7 are structured to send the sheet 2*b* and the one side printed sheet 2*b* into the sheet positioning section 3 alternately, the sufficient time can be ensured to allow the one side printed sheet 2 to drop onto the sheet carrying section for turnover 7 being at a standstill and to stabilize.

Therefore, the duplex printing can be efficiently performed and the top and bottom register of the one side printed sheet 2*b* is prevented from out of alignment at the time of the duplex printing.

In addition, since the structure to send the one side printed sheet 2*b* into the sheet positioning section 3 once again is composed of the chain delivery section 5 to carry the both side printed sheet 2*b* to the delivery section 6 and the sheet carrying section for turnover 7 disposed below the chain delivery section 5, and the temporary fixing device 5*b* is disposed only in the chain delivery section 5, its cost and its setting space can be more reduced in compared with those in the printer disclosed in JP 2015-11178 A.

The electro-photographic sheet of paper duplex printing machine 1 as shown in FIG. 1 can reduce its setting space still more, because the sheet dropping position 5*a* of the chain delivery section 5 is located above the sheet supply section 2, and the sheet turnover carrying section 7 is disposed between the sheet dropping position 5*a* and the sheet supply section 2.

Since the electro-photographic sheet of paper duplex printing machine 1 is constructed to send the sheet 2*b* from the sheet supply section 2 and the one side printed sheet 2*b* from the sheet carrying section for turnover 7 into the sheet positioning section 3 alternately, non-printed sheet 2*b* with one side to be printed and one side printed sheet 2*b* with the other side to be printed at the time of a duplex printing can be carried to the electro-photographic printing section 4 alternately and printed alternately, and then both side printed sheet 2*b* can be carried to the delivery section 6 at regular intervals, and it is possible for the double side printed sheet 2*b* to pass through the fixing device 6*a* at regular intervals.

Therefore, temperature changes in the fixing device 6*a* at the time of printing can be small and so the quality of the product can be stabilized.

Next, the structure of the sheet supply section 2 will be explained in detail based on FIG. 2 and FIG. 3.

Figure 2:
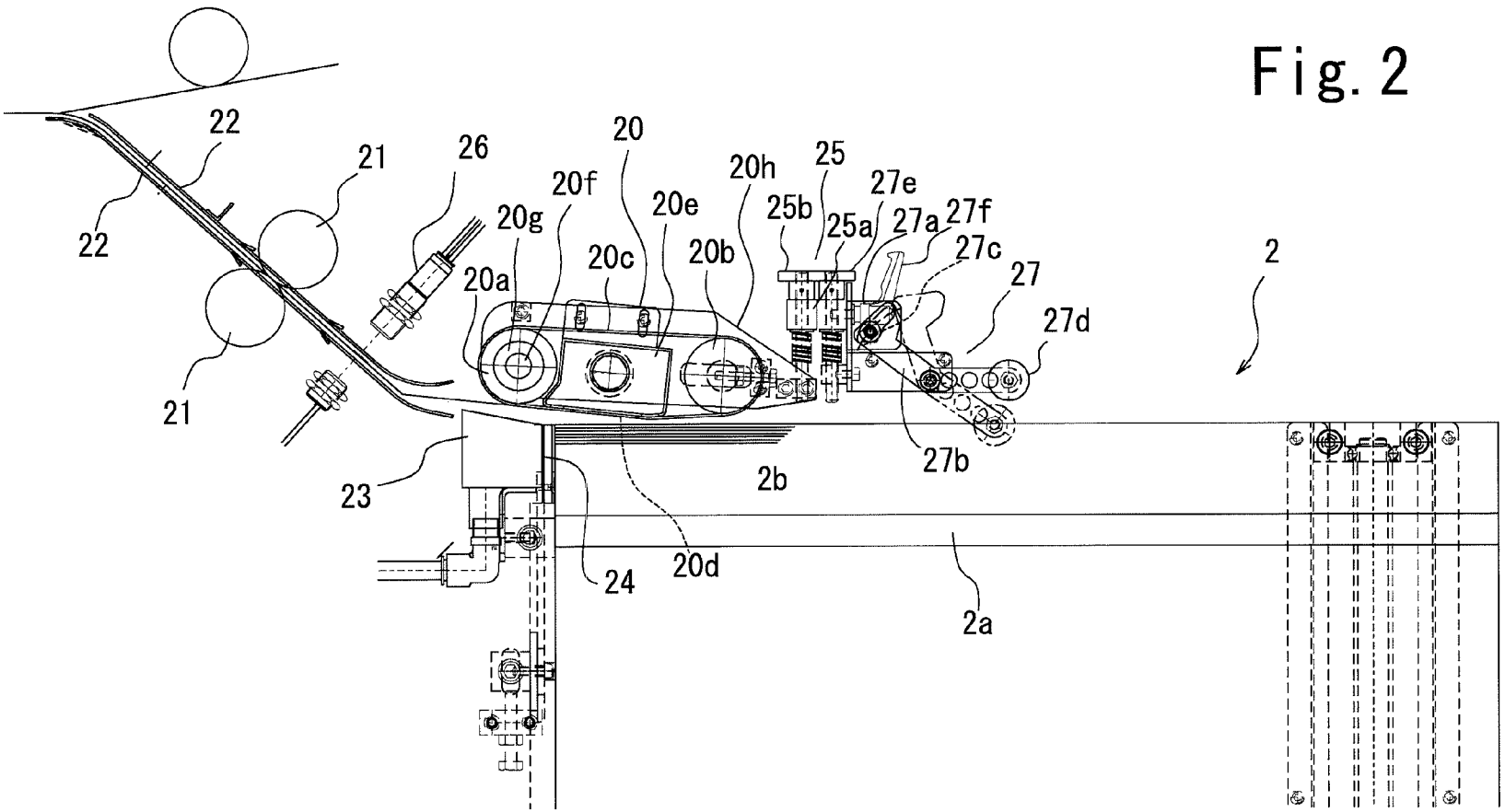
FIG. 2 is a front view that illustrates a structure of a sheet supply section.
Figure 3:
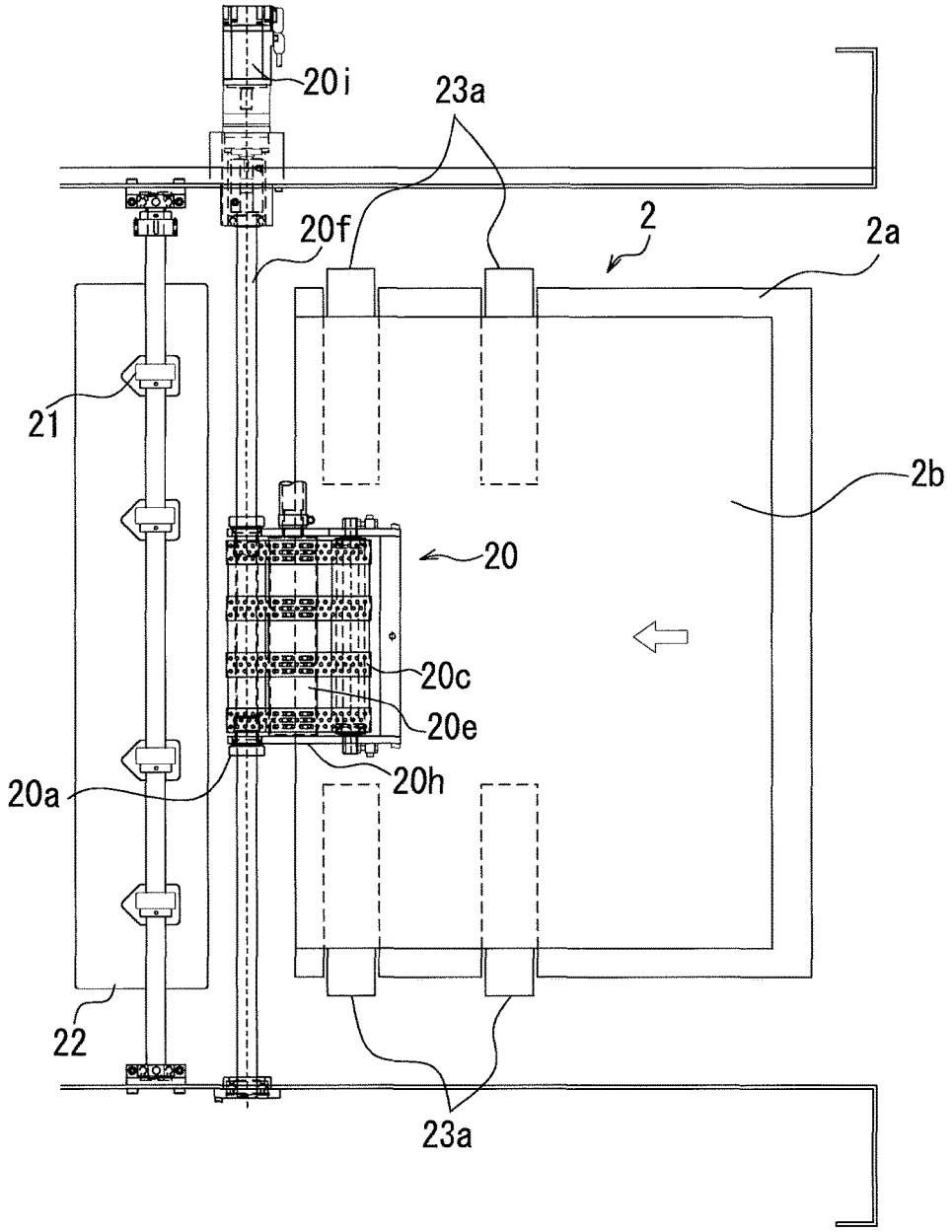
FIG. 3 is a plan view that illustrates a structure of the sheet supply section.

FIG. 2 is a front view that illustrates a structure of a sheet supply section and FIG. 3 is a plan view that illustrates a structure of the sheet supply section. In addition, the reduction scale of FIG. 3 differs from the reduction scale of FIG. 2.

The sheet supply section 2 comprises the first suction conveyer 20 carrying the sheet 2*b* loaded on the elevating table 2*a* one by one from the top, a pair of upper and lower first feed rollers 21 and a pair of upper and lower first sheet guides 22.

Since the sheets 2*b* loaded on the elevating table 2*a* are in condition to be apt to stick each other by static electricity, a plurality of the sheets 2*b* may be piled up and carried at a time.

To prevent this, the sheet supply section 2 is provided with an air blowing duct 23 and a projecting piece (stopper) for preventing a multi-feeding 24.

The air blowing duct 23 and sheet guides 23*a* for using also as air blowing ducts blow sheet handling air in 3 directions, namely blow to the end face (distal surface) of the sheet 2*b* at the downstream side in its carrying direction, and blow to both the lateral (right and left) end faces of the sheet 2 in the directions orthogonal to its carrying direction, whereby uppermost sheet 2*b* is floated by power of the air to be separated from the residue.

The end faces of the sheets 2*b* abut on the projecting piece 24 for a preventing a multi-feeding, and then the uppermost sheet 2*b* is sent out across the projecting piece for preventing a multi-feeding 24. In this way, more than one sheet 2*b* is prevented from sending out at a time (a multi-feeding).

The first suction conveyer 20 comprises a porous conveyer belt 20*c* wound around a drive roller 20*a*, a driven roller 20*b* so as to be driven and a suction duct 20*e* which is disposed inside of the porous conveyer belt 20*c* and has a suction port 20*d*. The first suction conveyer 20 is installed above the sheets 2*b* loaded on the elevating table 2*a* and the under surface of the porous conveyer belt 20*c* is opposite to the upper surface of the sheet 2*b* with a small gap (e.g., a gap of 0.3 mm etc.).

And the porous conveyer belt 20*c* sucks the sheet 2*b* by sucking air in the suction duct 20*e* with a suction machine not shown in the drawings and the porous conveyer belt 20*c* is turned by driving the first suction conveyer 20 and carries the sheet 2*b*. This air suction is always carried out during the operation of the electro-photographic sheet of paper duplex printing machine 1, but the drive of the first suction conveyer 20 is carried out intermittently. In other words, the first suction conveyer 20 is temporarily stopped to drive after it delivers the sheet 2*b* to the pair of first feed rollers 21.

The pair of first feed rollers 21 are disposed at the downstream side of the first suction conveyer 20 in the carrying direction.

The carrying procedure of the sheet 2*b* by the sheet supply section 2 will be explained in the following.

At first, the uppermost sheet 2*b* loaded on the elevating table 2*a* is sucked to the under surface of the first suction conveyer 20 (the under surface of the porous conveyer belt 20*c*) by sucking air in the suction duct 20*e* of the first suction conveyer 20. At this point of time, the first suction conveyer 20 is in the state that it is stopped to drive (the state that the porous conveyer belt 20*c* is stopped to turn).

And the sheet 2*b* is carried along the first sheet guide 22 up to the pair of first feed rollers 21 rotating at a constant speed when the first suction conveyer 20 is driven.

The timing at which the first suction conveyer 20 is driven is determined by the signal from a proximity sensor (will be explained in detail later) installed near a gear of the transfer roller 40 of the electro-photographic printing section 4. In addition, for example, the sheet carrying speed of each of the pair of first feed rollers 21 is the same as that of the backup roller 41 of the electro-photographic printing section 4 to make sure not to be different from the sheet carrying speed of the backup roller 41.

At the stage of the front end edge of the sheet 2*b* being put between the contact portions (nip part) of the pair of first feed rollers 21, the first suction conveyer 20 is stopped to carry.

Feed length of the sheet 2*b* so far is somewhat less than the top to bottom size of the shortest sheet 2*b*. In other words, the distance from the projecting piece for preventing a multi-feeding 24 to the contact portions of the pair of first feed rollers 21 is somewhat shorter than the top to bottom size of the shortest sheet 2*b*.

Hereafter, the sheet 2*b* is carried to the sheet positioning section 3 by the rotation of the first feed rollers 21.

A drive shaft 20*f* of the drive roller 20*a* of the first suction conveyer 20 can be driven to rotate in the carrying direction of the sheet 2*b* (clockwise direction in FIG. 2) by a servomotor 20*i*.

Furthermore, one way clutch 20*g* is interposed between the drive shaft 20*f* and the drive roller 20*a*, and thereby the rotation in the carrying direction of the drive shaft 20*f* is transmitted to the drive roller 20*a* by the one way clutch 20*g* and the drive roller 20*a* rotates in the carrying direction freely with respect to the drive shaft 20*f*. In other words, as far as the first suction conveyer 20, the porous conveyer belt 20*c* (the first suction conveyer 20) can freely turn only in the carrying direction of the sheet 2*b* (clockwise direction in FIG. 2) by the action of the one way clutch 20*g* even if the drive shaft 20*f* is at a standstill.

Thus, since the upstream portion (rear end portion) of the sheet 2*b* is suck to the porous conveyer belt 20*c* of the first suction conveyer 20 which stops the rotational driving when the sheet 2*b* is carried by the first feed rollers 21, a load is applied to the carriage of the sheet 2*b* by the first feed rollers 21, but the load can be reduced because the first suction conveyer 20 freely turns by the action of the one way clutch 20*g*.

When the sheet 2*b* suck to the first suction conveyer 20 is carried by the first feed rollers 21, a contact area between the sheet 2*b* and the first suction conveyer 20 gradually becomes small. In inverse proportion to this, the numbers of the suction ports of the porous conveyer belt 20*c* that are not blocked up by the sheet 2*b* increase, and a suction force for the sheet 2*b* of the porous conveyer belt 20*c* becomes small.

Accordingly the first suction conveyer 20 comes to a stop without freely turning because of a reduced rotational driving force by the sheet 2*b*, and thereby the sheet is carried in slide contact with the surface of the first suction conveyer 20, while it is suck by the suction force of the first suction conveyer 20 which is becoming gradually weak.

Furthermore, when the sheet 2*b* is carried and the rear end portion of the sheet 2*b* leaves a part of the suction ports 20*d* of the suction duct 20*e* near the driven roller 20*b* of the first suction conveyer 20, the following second sheet 2*b* from the top loaded on the elevating table 2*a* is then suck to the part of the suction ports 20*d* of the suction duct 20*e* near the stopped driven roller 20*b* of the first suction conveyer 20.

Thereafter the rear end portion of the preceding sheet 2*b* passes through the suction ports 20*d* of the suction duct 20*e* and the sucking of the preceding sheet 2*b* to the first suction conveyer 20 disappears, the servomotor 20*i* of the first suction conveyer 20 is driven and then the first suction conveyer 20 is driven by a rotation of the drive shaft 20*f* to carry the following stuck sheet 2*b*.

At this time, a timing to drive the servomotor 20*i* of the first suction conveyer 20 is determined as follows.

A proximity sensor is installed opposite to the gear rotationally driving the transfer roller 40 of the electrophotographic printing section 4 and to detect one revolution of the transfer roller 40. For example, this gear is attached to the transfer roller 40 coaxially with the transfer roller 40, and the transfer roller 40 rotates one revolution when this gear rotates one revolution. A detection signal from the proximity sensor and a pulse sent from a servomotor and the like not shown in the drawings, which drives the transfer roller 40 or an encoder not shown in the drawings, which is directly attached to the transfer roller 40 are taken into a control section not shown in the drawings.

The said control section outputs an operation signal mainly based on the result of calculation of a detection signal from the proximity sensor and the number of the pulses and drives the servomotor 20*i* of the first suction conveyer 20 by the operation signal.

In addition, the said proximity sensor sends the detection signal once per one revolution of the transfer roller 40. For example, in the case where the transfer roller 40 is a 4 times roller (roller printing four pieces of the sheets 2*b* at one revolution), the control section calculates a quarter of the number of the sent pulses while receiving the detection signal and outputs the operation signal when the calculated number of the pulses is input into the said control section.

In other words, since one piece of the sheet 2*b* is carried and printed whenever the transfer roller 40 rotates a quarter revolution, the operation signal is output every a quarter revolution of the transfer roller 40 and, in the case of a duplex printing, the servomotor 20*i* is driven by an every other operation signal so that the sheet 2*b* is carried from the sheet supply section 2 every a half revolution of the transfer roller 40.

In the case of one side printing, the servomotor 20*i* is driven every each operation signal so that the sheet 2*b* is carried from the sheet supply every a quarter revolution of the transfer roller 40. In other words, an operation signal can be linked with specific one of four toner images on the transfer roller 40. From this reason, for example, the number of the sheet stored and the position of the specific sheet 2*b* in the carrying section in term of the position or the phase of the specific toner image can be determined by the calculation in the said control section.

As shown in FIG. 2, the first suction conveyer 20 is inclined with respect to the horizontal plane so that its downstream side in the carrying direction becomes higher than its upstream side in the carrying direction. This inclined angle is adjustable by an angle adjustment mechanism 25 shown in FIG. 2.

In other words, a frame 20*h* of the first suction conveyer 20 is supported swingably up and down by a main body frame 1*a* of the electro-photographic sheet of paper duplex printing machine 1, a screw 25*b* is screwed and attached to a member 25*a* attached to the main body frame 1*a*, and the screw 25*b* is connected to the frame 20*h*, to make the angle adjustment mechanism 25.

The frame 20*h* is swung up or down by turning the screw 25*b* in tightening or loosening direction, and thereby the inclined angle of the first suction conveyer 20 is changed.

Furthermore, a two-sheet feeding detection sensor 26 is installed between the first suction conveyer 20 and the first feed rollers 21. In this embodiment, a supersonic wave-type two-sheet feeding detection sensors 26 is used, but other sensors may be used.

The sheet supply section 2 comprises a sheet height detection mechanism 27 for detecting a height of the sheet 2*b* loaded on the elevating table 2*a*.

This sheet height detection mechanism 27 has a frame 27*a* attached to the member 25*a*, an arm 27*b* attached swingably up and down to the frame 27*a* and a proximity sensor 27*c* attached to the frame 27*a*. A roller 27*d* attached to the arm 27*b* is in contact with the sheet 2*b*, and the arm 27*b* swings up and down in response to a change of height of the sheet 2*b*.

In the state of the arm 27*b* shown by a solid line in FIG. 2, the proximity sensor 27*c* detects the arm 27*b* and outputs a signal. In addition, the frame 27*a* is adjust in its attachment height position in the top to bottom direction to the member 25*a* with a screw 27*e*, and is thereafter fixed to the member 25 with a clamp lever 27*f*.

In the state of the arm 27*b* shown by an imaginary line in FIG. 2, the proximity sensor 27*c* does not output a signal because it does not detect the arm 27*b*.

The signal from the proximity sensor 27*c* is input into an elevating table control section not shown in the drawings. The elevating table control section elevates the elevating table 2*a* when the signal is not input, and comes to a stop when the signal is input.

Therefore, the elevating table 2*a* comes to a stop when the height of the sheet 2*b* becomes the highest (predetermined sheet feed height), because the proximity sensor 27*c* detects the arm 27*b* and outputs the signal.

When a certain number of sheets 2*b* is carried from this state, the height of the sheet 2*b* becomes lower than a certain height, and the arm 27*b* is in a condition as shown by an imaginary line, and the proximity sensor 27*c* does not output a signal, and thereby the elevating table control section elevates the elevating table 2*a*. And when the height of the sheet 2*b* becomes high to reach the highest (predetermined sheet feed height), the proximity sensor 27*c* outputs a signal, and thereby the elevating table control section stops to elevate the elevating table 2*a*.

In this way, the height of the sheet 2*b* is prevented from becoming lower than a certain height.

In this embodiment, the central position of the sheet 2*b* in the sheet supply section 2 in the direction orthogonal to the carrying direction (the right angle direction in the sheet surface, same as follows) is shifted slightly, e.g., about 5 mm in the direction orthogonal to the carrying direction from the central position in the direction orthogonal to the carrying direction of the sheet supply section 2. This is for the operation to position the sheet 2*b* in the sheet positioning section 3.

Figure 4:
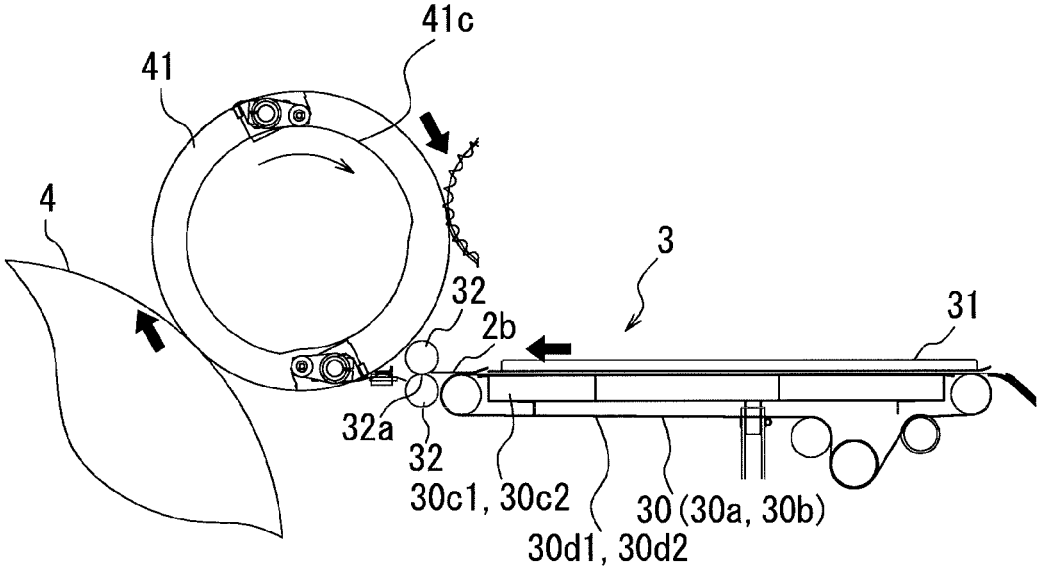
FIG. 4 is a front view that illustrates a structure of a sheet positioning section.

Next, the structure of the sheet positioning section 3 will be explained in detail based on FIG. 4 and FIG. 5.

The sheet positioning section 3 comprises a suction conveyer 30, a lateral positioning board 31 and a upper and lower pair of registration rollers 32, and positions to determine the position in the top to bottom direction and the position in the lateral direction of the sheet 2*b* sent out from the sheet supply section 2. The position in the top to bottom direction of the sheet 2*b* is a position in the sheet carrying direction, and the position in the lateral direction thereof is a position in the direction orthogonal to the sheet carrying direction in the sheet surface.

The suction conveyer 30 has a straight suction conveyer 30*a* and an inclined suction conveyer 30*b* installed between the lateral positioning board 31 and the straight suction conveyer 30*a*.

The straight suction conveyer 30*a* is located in parallel to the carrying direction of the sheet 2*b* sent out from the sheet supply section 2. The inclined suction conveyer 30*b* is located at a slant with respect to the direction parallel to the carrying direction of the sheet 2*b* (the straight suction conveyer 30*a*) so that its downstream side in the carrying direction (front end side) is nearer the lateral positioning board 31 than its upstream side in the carrying direction (rear end side).

The suction conveyers 30*a*, 30*b* have suction ducts 30*c*1 and 30*c*2 having suction ports and porous conveyer belts 30*d*1 and 30*d*2, and is constructed to suck the sheets 2*b* to the porous conveyer belts 30*d*1 and 30*d*2 by sucking air from the plurality of suction ports opened in the porous conveyer belts 30*d*1 and 30*d*2 so as to carry the sheets 2*b* stick to the porous conveyer belts 30*d*1 and 30*d*2, respectively. The suction conveyers 30*a*, 30*b* are so set that air suction power through the porous conveyer belt 30*d*2 of the inclined suction conveyer 30*b* is stronger than air suction power through the porous conveyer belt 30*d*1 of the straight suction conveyer 30*a* by changing number or size of the ports of the porous conveyer belt 30*d*1 and 30*d*2 or changing suction powers themselves of the suction ducts 30*c*1 and 30*c*2, respectively.

Therefore, the sheet 2*b* is carried to the lateral positioning board 31 diagonally by carrying power of the inclined suction conveyer 30*b*, and is carried to go along the lateral positioning board 31 after one of the lateral end faces of the sheet 2 comes in contact with the lateral positioning board 31, and thereby the position in the lateral direction thereof is determined.

At the time of this movement, the inclined angle and air suction power of the inclined suction conveyer 30*b* is so set that the sheet 2*b* does not get over the lateral positioning board 31. The lateral positioning board 31 is moved in parallel in the lateral direction according to size (dimensions in the lateral direction) of the sheet 2*b* and thereby its position in the lateral direction can be adjusted.

In addition, since the sheet carrying direction (direction of movement) of the inclined suction conveyer 30*b* is different from the sheet carrying direction (direction of movement) of the straight suction conveyer 30*a*, a force for lengthening the sheet 2*b* in the lateral direction is applied and can prevent the sheet 2*b* from bending, In addition, behavior of the sheet 2*b* is stable because the sheet carrying speeds of the suction conveyers 30*a*, 30*b* (turning speeds of the porous conveyer belts 30*d*1 and 30*d*2) are uniform, respectively.

For example, the sheet carrying speed of each of the suction conveyers 30*a*, 30*b* is the same as the sheet carrying speed of the backup roller 41 of the electro-photographic printing section 4 and is prevented from varying from the sheet carrying speed of the backup roller 41. In this case, the sheet carrying speed (actual carrying speed) in the sheet carrying direction of the inclined suction conveyer 30*b* becomes slightly slower than the sheet carrying speeds of the backup roller 41 and the straight suction conveyer 30*a* by the inclination, but it does not have any problem. In addition, the sheet carrying speed in the sheet carrying direction of the inclined suction conveyer 30*b* may be the same as the sheet carrying speed of the backup roller 41 and the straight suction conveyer 30*a*.

The upper and lower pair of registration rollers 32 is installed at downstream side in the carrying direction of the suction conveyer 30.

The front end edge of the sheet 2*b* carried by the suction conveyer 30 comes in contact with the upstream side of contact portions (nip part) 32*a* of the upper and lower pair of registration rollers 32, and thereby the position in the top to bottom direction thereof is determined. The surface portion of each of the registration rollers 32 is made of a material having large coefficient of friction such as the rubber in order to prevent the sheet 2*b* nipped with the upper and lower pair of registration rollers 32 from slipping.

In addition, the upper registration roller 32 is provided with a plurality of cutouts 32*b* in order not to interfere with a sheet support (here as an example, a clamp) and a stopper projecting from the peripheral surface of the backup roller 41.

Generally speaking, when intending to pushed the sheet 2*b* until it comes in contact with the upstream side of the contact portions 32*a* of the upper and lower pair of registration rollers 32, the sheet 2*b* could not be entered until it comes in contact with the upstream side of the contact portions 32*a* of the upper and lower pair of registration rollers 32 depending on the carrying angle of the sheet 2*b* and the carrying power applied to the sheet 2*b*.

In this embodiment, the sheet 2*b* is horizontally carried by the suction conveyer 30, and the carrying surface of the suction conveyer 30, that is, the sheet carrying height position is the same as the height position of the contact portions 32*a* of the upper and lower pair of registration rollers 32. The height position is the position in the top to bottom direction.

Therefore, since the sheet 2*b* is moved straight towards the upstream side of the contact portions 32*a* of the upper and lower pair of registration rollers 32 and is pushed into the deeper inside of the gradually narrowed space that is formed between the peripheral surfaces of the upper and lower pair of registration rollers 32, the front end edge of the sheet 2*b* can easily come in contact with the upstream side of the contact portions 32*a* of the upper and lower pair of registration rollers 32, and thereby the position in the top to bottom (top and bottom) direction of the sheet 2*b* can easily be determined.

Furthermore, since friction develops between the upper and lower pair of registration rollers 32, and the rear end portion of the sheet 2*b* is suck by air suction of the suction conveyer 30 so that the carrying power is applied to the sheet 2*b*, the sheet 2*b* is prevented from rebounding on the registration roller 32 when the sheet 2*b* comes in contact with the upstream side of the contact portions 32*a* of the upper and lower pair of registration rollers 32.

In the printing machines disclosed in above described JP 2013-107760 A and JP 2015-11178 A, the front end edge of the sheet is brought into contact with an front pad (first front regulation stopper 62 of JP 2013-107760 A, front pad 23 of JP 2015-11,178 A) and is brought to a stop for positioning in the top to bottom direction.

However, rebound of the sheet generally occurs when the front end edge of the sheet running at high speed comes in contact with the front pad and comes to a stop, which results in incorrect position accuracy in the top to bottom direction of the sheet.

To prevent this, in the printing machine disclosed in JP 2013-107760 A, rebound of the sheet is tried to be prevented by strengthening the contact force of the sheet with the belt by suction of the second sucking mechanism 49, but since the part of the sheet in contact with the second sucking mechanism is structurally limited to only a part of the upstream side of the sheet when the sheet comes in contact with the front pad, its sucking effect is weak, so that rebound of the sheet cannot be surely prevented.

In the printing machine disclosed in JP 2015-11,178 A, the speed of the sheet carrying conveyer 20 is decreased when the sheet is brought into contact with the front pad in order to prevent rebound of the sheet, and then the speed of the sheet carrying conveyer 20 is increased to send the sheet into the printing section, and then the speed of the sheet carrying conveyer 20 is still further increased to carry the next sheet. However, behavior of the sheet is made unstable because the speed change of the sheet carrying conveyer 20 is large.

On the contrary, in the sheet positioning section 3 of this embodiment, the positioning in the top to bottom direction of the sheet 2*b* is performed by using the registration roller 32 and the suction conveyer 30, so that rebound of the sheet 2*b* can be surely prevented.

Figure 6:
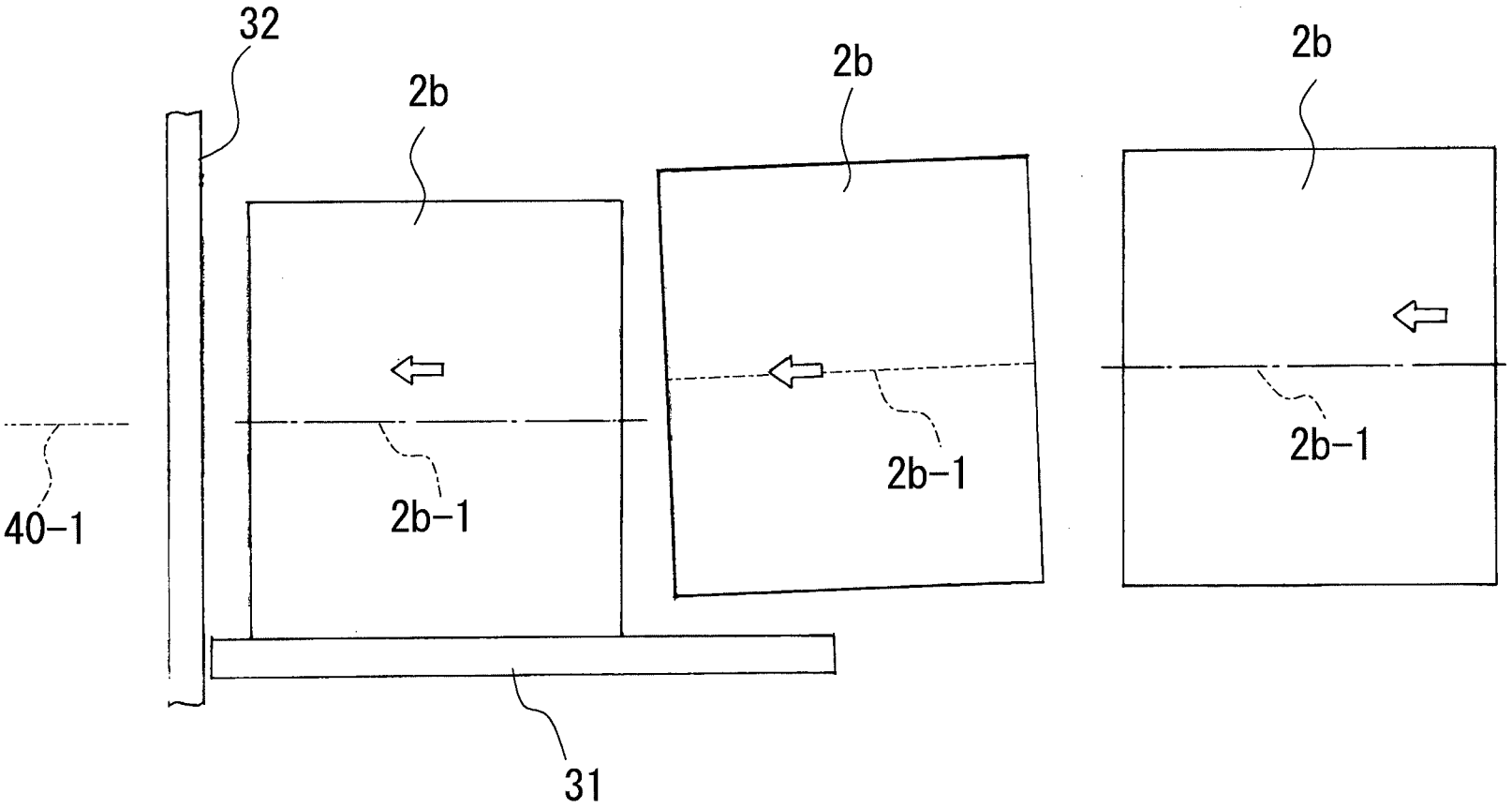
FIG. 6 is a plan view for explaining a positioning operation of the sheet.

In addition, since the sheet 2*b* is moved in one of the lateral directions to be brought into contact with the lateral positioning board 31 in order to be positioned in the lateral direction as shown in FIG. 6, in the sheet positioning section 3, the central position in the direction to the carrying direction of the sheet 2*b*, i.e. the central positions 2*b*-1 of the sheet while carrying and the sheet after being positioned are displaced each other in the lateral direction.

And, the central position 2*b*-1 of the positioned sheet in the lateral direction is made matched with the central position 40-1 in the axial direction of the transfer roller 40.

Therefore, the central position 2*b*-1 in the lateral direction (central position in the direction orthogonal to the carrying direction) of the sheet 2*b* loaded on the sheet supply section 2 is displaced from the central position 40-1 in the axial direction of the transfer roller 40 (central position in the direction orthogonal to the carrying direction of the sheet supply section 2) of the transfer roller 40 and is made matched with the central position of the sheet 2*b* in the lateral direction just before that it is carried into the sheet positioning section 3.

In this way, the sheet 2*b* can be carried without bending or wrinkling from the sheet supply section 2 towards the sheet positioning section 3.

Figure 5:
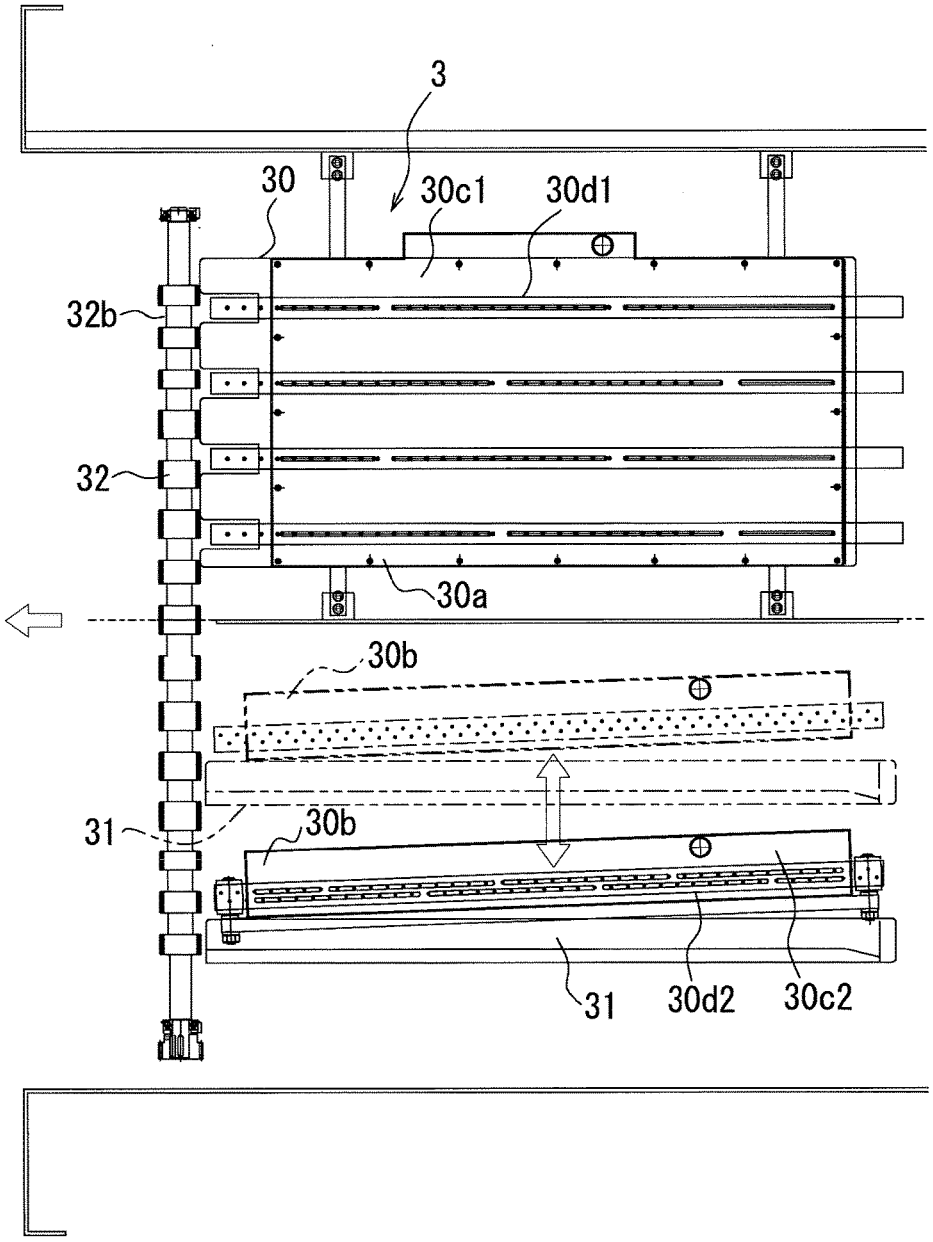
FIG. 5 is a plan view that illustrates a structure of the sheet positioning section.

As shown in FIG. 5, the lateral positioning board 31 is attached to the inclined suction conveyer 30*b* and the inclined suction conveyer 30*b* is attached to the lateral positioning board 31, thereby the inclined suction conveyer 30*b* and the lateral positioning board 31 are moved as one body in the lateral direction.

Therefore, the straight suction conveyer 30*a* and the inclined suction conveyer 30*b* are separated laterally and a big space is resulted between the straight suction conveyer 30*a* and the inclined suction conveyer 30*b*, thus, when a sheet 2*b* of big size is carried and is positioned, a part of the sheet 2*b* hangs down in this space, and the positioning operation of the sheet 2*b* is rendered to be uncertain.

Therefore, a sheet tray, not illustrated, which is extendable and variable in its lateral dimensions, e.g., an accordion sheet tray is installed between the straight suction conveyer 30*a* and the inclined suction conveyer 30*b*.

Next, the structure of the electro-photographic printing section 4 will be explained in detail based on FIG. 7.

The electro-photographic printing section 4 comprises the backup roller 41, the transfer roller 40 in contact with the backup roller 41, and the electro-photographic printing units 42 and a cleaning unit 43 which are disposed around the transfer roller 40.

The electro-photographic printing unit 42 is a printing unit of the electro-photographic type, in which an electrostatic latent image based on an image data is formed on a photoconductor drum 42*a* and a liquid toner is attached to this electrostatic latent image to make a toner image and the toner image is transferred to the transfer roller 40.

And, the toner image transferred to the transfer roller 40 is transferred to the sheet 2*b* in its rotational contact area with the backup roller 41 and is printed thereon.

In this embodiment, since the diameter of the backup roller 41 is double the diameter of the photoconductor drum 42*a*, two pieces of the sheet 2*b* can be wrapped around the peripheral surface of the backup roller 41 to be held by clamps 41*a*.

In addition, since the diameter of the transfer roller 40 is four times of the diameter of the photoconductor drum 42*a*, four toner images are transferred to the peripheral surface of transfer roller 40. The diameters of the backup roller 41 and the transfer roller 40 are not limited to these radius values.

The backup roller 41 is provided with the clamps 41*a* to grip the sheets 2*b* to hold them on the peripheral surface of the backup roller 41 and stoppers 41*b* serving as a reference with which the front end edge of the sheet 2*b* is brought into contact. The clamp 41*a* and the stopper 41*b* are projected from the peripheral surface of the backup roller 41. Cutouts 40*a* are formed on the peripheral surface of the transfer roller 40 in order to avoid its interference with the clamps 41*a* and the stoppers 41*b* of the backup roller 41.

In addition, a jacket 40*b* of the transfer roller 40 is made of a base plate of stainless steel on which a surface layer of rubber material laid, and the base plate is stretched between the adjacent cutouts 40*a* of the transfer roller 40 so as to stick to the transfer roller 40. In other words, the both ends of this base plate of which the surface does not have the surface layer of rubber material are fixed to the transfer roller 40 in the adjacent cutouts 40*a* of the transfer roller 40. And, the toner image is transferred to the surface layer of rubber material of this jacket 40*b*.

The sheet 2*b* is carried towards the backup roller 41 by the upper and lower pair of registration rollers 32 of the sheet positioning section 3, and the front end edge of the sheet 2*b* comes in contact with the stopper 41*b* of the backup roller 41 and, in that state, the front end edge of the sheet 2*b* is gripped and held by the clamp 41*a*, so that the sheet is delivered to the backup roller 41 side.

Since the position of the stopper 41*b* of the backup roller 41 serves as a reference position of the sheet 2*b* in the print, the sheet 2*b* is delivered so as to be in contact with the stopper 41*b* of the backup roller 41.

Figure 7:
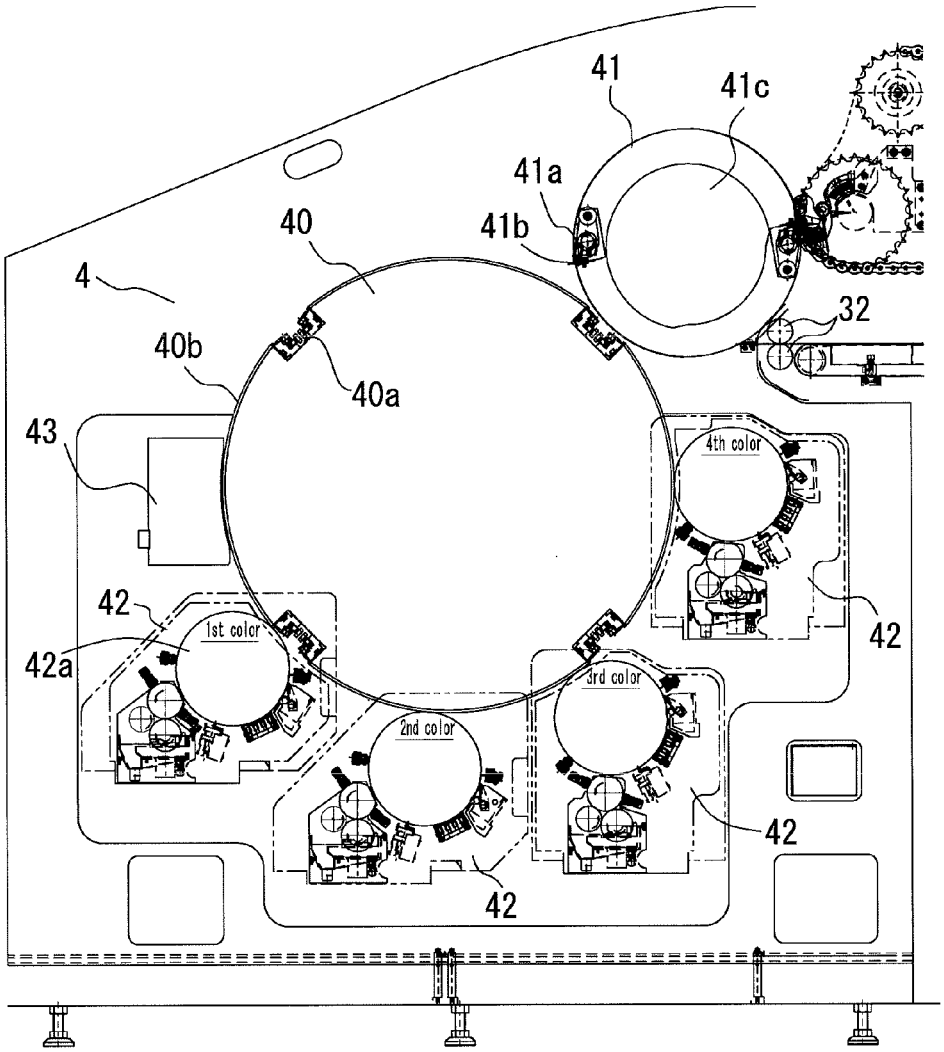
FIG. 7 is a front view that illustrates a structure of an electro-photographic printing section.

As shown in FIG. 7, the clamp 41*a* of the backup roller 41 is adjusted to be closed when the sheet 2*b* comes in contact with the stopper 41*b* of the backup roller 41 and to be opened when the clamp 41*a* moves to a delivering position close to the chain delivery section 5, by converting the motion of the cam follower moving up-and-down on the outer periphery of the cam 41*c* into rotational motion by mean of a cam 41*c*, a cam follower (not shown in the drawings) installed so as to be in rotational contact with the outer periphery of the cam 41*c*, a lever (not shown in the drawings) to which the cam follower is rotatably attached, and a constituent body (not shown in the drawings) having a shaft (not shown in the drawings) on which the lever and the clamp are mounted.

In other words, the clamp 41*a* is held open from the delivering position to the chain delivery section 5 to the delivered position (receipt position) from the sheet positioning section 3.

The cam 41*c* is formed in a circular shape having a large diameter part and a small diameter part and fixed on the main body frame independently from the backup roller 41. The clamp 41*a* is closed when the cam follower of the clamp 41*a* is in contact with the large diameter part of the cam 41*c* and opened when the cam follower of the clamp 41*a* is not in contact with the small diameter part of the cam 41*c* but is dropped toward the small diameter side. And, a phase positioning of the cam 41*c* is concentrically adjusted with the rotation center of the backup roller 41 so that continuation parts with the large diameter part and the small diameter part of the cam 41*c* corresponds to the respective positions of the sheet delivering positions.

Therefore, the cam 41*c* may be made of two superimposed pieces and, by doing so, the positions of the sheet receiving section and the sheet delivering section can be appropriately adjusted, respectively.

The backup roller 41 and the registration roller 32 can be located close each other by virtue of the cutouts 32*b* (FIG. 5) formed in the upper registration roller 32 (the registration roller 32 close to the backup roller 41) of the pair of registration rollers 32.

Accordingly, a delivery distance for delivering the sheet 2*b* from the registration roller 32 to the backup roller 41 is shortened and thereby an accurate transfer of the sheet is enabled.

The sheet carrying speed of the registration rollers 32 is usually the same as the sheet carrying speed of the backup roller 41, but they come to a stop when the sheet 2*b* carried by the suction conveyers 30*a*, 30*b* abuts against the contact portion 32*a* of the registration rollers 32.

Thereafter, the registration rollers 32 are driven at the speed higher than the normal sheet carrying speed thereof. Thus, the sheet carrying speed of the registration rollers 32 when delivering the sheet 2*b* to the clamp 41*a* of the backup roller 41 can be higher than sheet carrying speed of the backup roller 41.

The drive start timing of the registration roller 32 is determined by the signal from the proximity sensor installed opposite to the gear which rotationally drives the transfer roller 40 as with the suction conveyer 20 of the sheet supply section 2.

Figure 8:
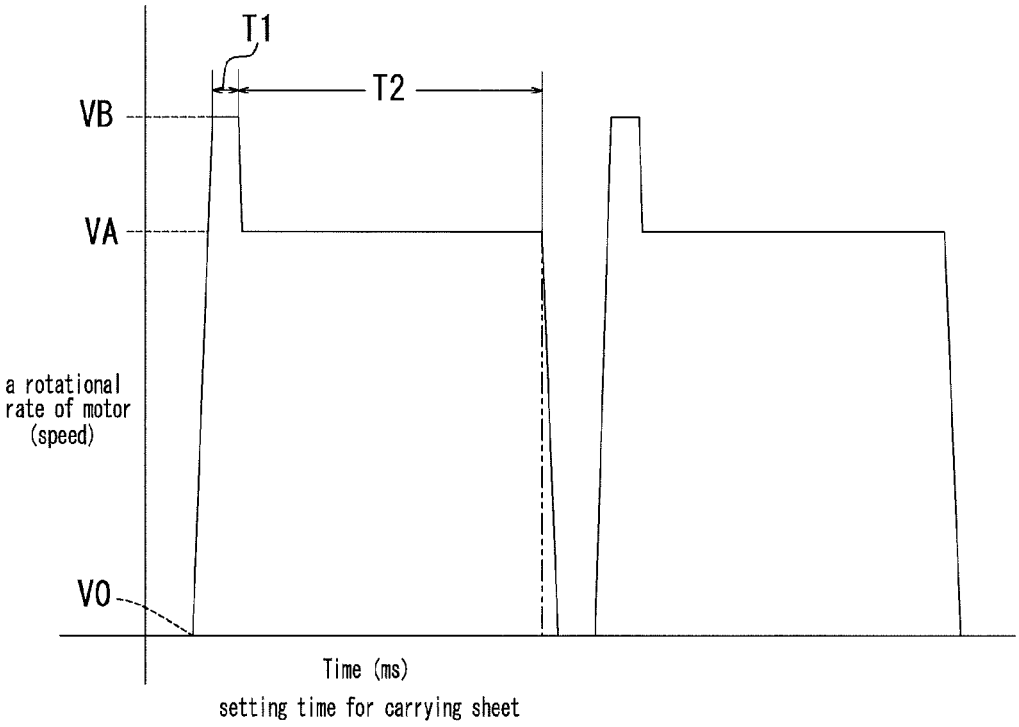
FIG. 8 is an explanatory view of an operation of a registration roller.

An example of the change of the sheet carrying speed of the registration roller 32 will be explained based on FIG. 8.

The sheet carrying speed is zero V0 just before the front end edge of the sheet 2*b* abuts against the contact portion 32*a*, and the drive of the registration roller is started when the front end edge of the sheet 2*b* abuts against the contact portion of the registration roller 32, and then the carrying speed is accelerated to the speed VB which is higher than the carrying speed VA of the backup roller 41. The registration roller 32 is driven at the speed VB for the first setting time T1. After this, the sheet carrying speed is decelerated to the carrying speed VA, and the registration roller 32 is driven at the speed VA for the second setting time T2. After the lapse of second setting time T2, the registration roller 32 is decelerated and stopped.

In this example, the registration roller 32 has a carrying speed VB higher than the sheet carrying speed VA of the backup roller 41 when delivering the sheet 2*b* to the clamp 41*a* of the backup roller 41. For example, the speed VB is optionally set at the speed not less than 105% and not more than 150% of the speed VA. If the sheet carrying speed VB is too high, the front end edge of the sheet 2*b* abuts too strong against the stopper 41*b* of the backup roller 41, and thereby malfunction such as a wrinkle produced in the sheet 2*b* arises.

On the contrary, if the sheet carrying speed VB is too low, paper 2*b* does abut against the stopper 41*b* of the backup roller 41, thus, the paper holding position of the backup roller 41 deviates, and thereby a misalignment of the print position and a failure of gripping the front end of the sheet 2*b* by the clamp 41*a* of the backup roller 41 will arise.

As for this, the condition changes according to the kind of the sheet 2*b* and the environment at the time of use. Therefore, speed VB can be arbitrarily set by a control section not shown in the drawings.

The transfer roller 40 is capable of contacting with and separating from the backup roller 41 as one body with the electro-photographic printing units 42 and the cleaning unit 43. Furthermore, the electro-photographic printing unit 42 is capable of contacting with and separating from the transfer roller 40.

Figure 9:
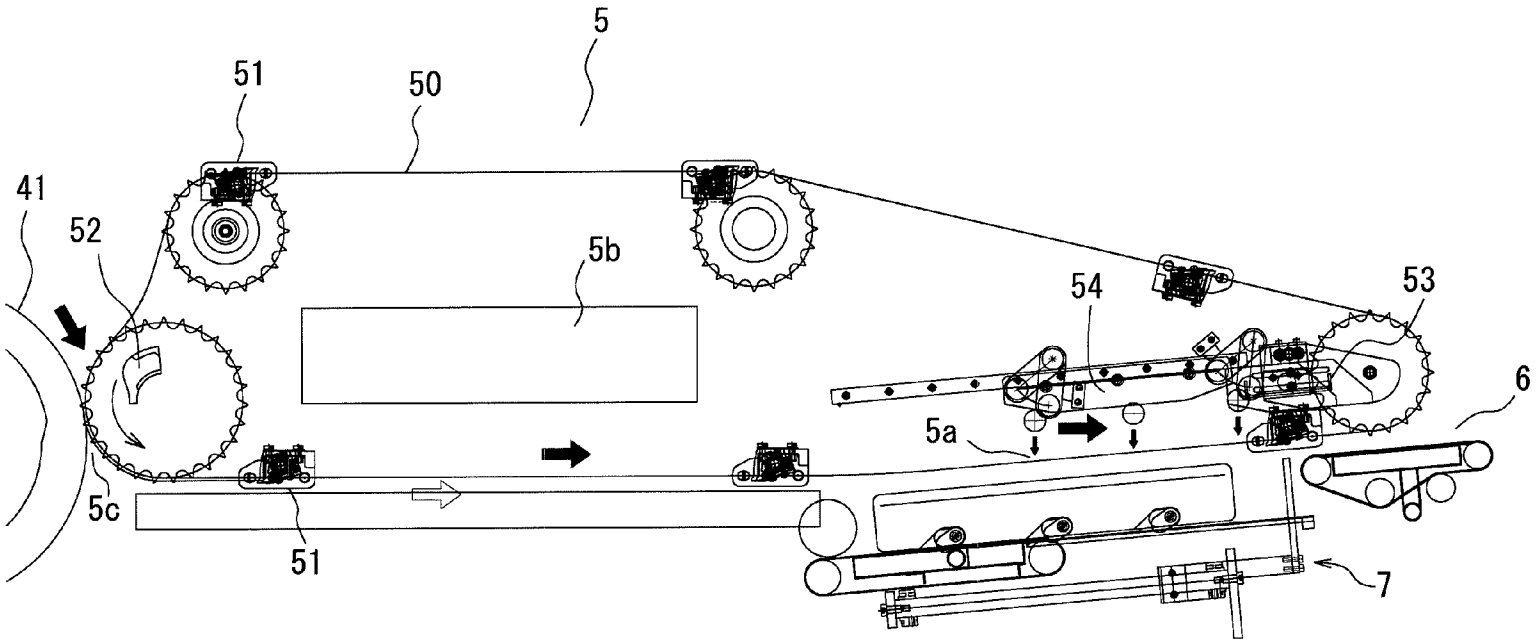
FIG. 9 is a front view that illustrates a structure of a chain delivery section.

Next, the structure of the chain delivery section 5 will be explained in detail based on FIG. 9.

The chain delivery section 5 comprises an endless chain 50 which is turnably driven and grippers 51 which are attached to the chain 50. The gripper 51 is brought into open position by an opening cam 52. The opening cam 52 is located near the backup roller 41 and the gripper 51 is closed after being opened once by the opening cam 52 and holds the sheet 2*b* by gripping the front end of the printed sheet 2*b*.

Therefore, a means to grip the printed sheet 2*b* after printing to which a toner image was transferred is changed from the clamp 41*a* of the backup roller 41 to the gripper 51 of the chain delivery section 5 at a gripping change position 5*c*, and then the printed sheet 5*b* is carried towards a delivery section 6.

The temporary fixing device 5*b* is located between the gripping change position 5*c* and the sheet dropping position 5*a*, and a toner image on the printed sheet 2*b* is temporarily fixed by this temporary fixing device 5*b*. In this embodiment, the temporary fixing device 5*b* is an IR heater, and specifically it uses a carbon heater and so forth.

By temporarily fixing the toner image on the printed sheet 2*b*, the toner printed (transferred) on the sheet 2*b* is prevented from attaching to rollers in subsequent processes. In addition, complete fixing of a toner in temporary fixation is unfavorable because print quality of the back side turns worse under the influence of decreasing of water contained in the printed sheet 2*b*.

The gripper 51 is brought into open by an opening cam for ejection 53 and an opening cam for dropping 54.

The opening cam for ejection 53 is located near the delivery section 6. The opening cam 54 for dropping is located at the upstream side in the carrying direction than the opening cam for ejection 53 and above the sheet dropping position 5*a* and the opening cam 54 for dropping moves between the operating position to make the gripper 51 open and the non-operating position to hold the gripper 51 close.

In this way, the chain delivery section 5 reaches the first state when the opening cam for dropping 54 is located at the non-operating position and the printed sheet 2*b* is carried to the delivery section 6. The chain delivery section 5 reaches the second state when the opening cam for dropping 54 is located at the operating position and the printed sheet 2*b* is dropped on the sheet turnover carrying section 7 from the sheet dropping position 5*a*.

In other words, at the sheet dropping position 5*a*, the carrying path of the printed sheet 2*b* branches off into two. In the duplex printing, one side printed sheet 2*b* which only one side printing has been completed is dropped onto the sheet carrying section for turnover 7 for printing on the other side thereof. The one side printed sheet 2*b* which one side printing has been completed in the one side printing or the both side printed sheet 2*b* which both side printing has been completed in the duplex printing is sent to the delivery section 6 without being dropped.

In addition, the opening cam 54 for dropping is able to move in the sheet carrying direction to adjust its position depending on the sheet size.

Figure 10:
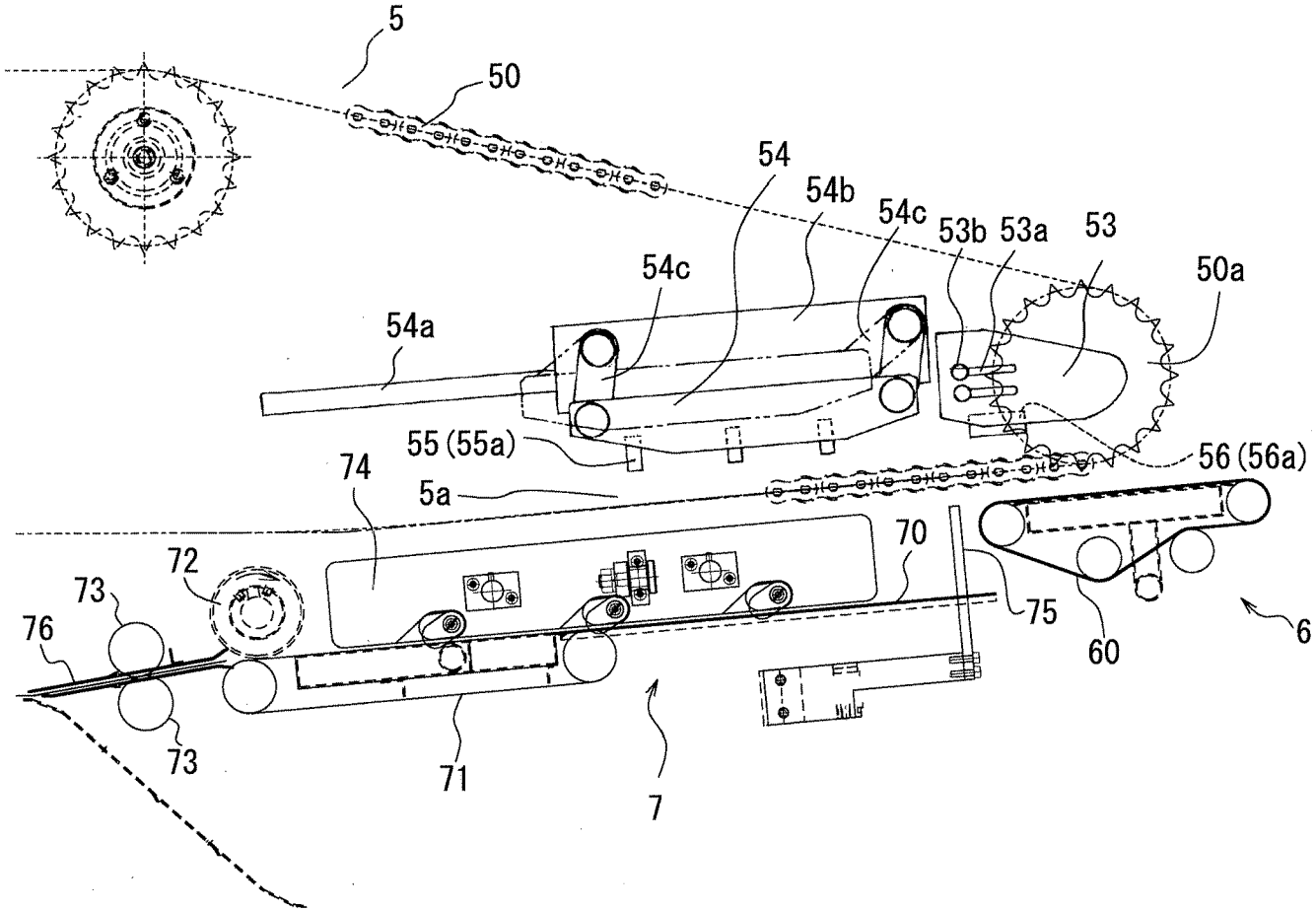
FIG. 10 is a front view that illustrates structures of a sheet carrying section for turnover and a sheet dropping position portion.

An example of the installation of the opening cam 54 for dropping will be explained based on FIG. 10

A cam guide 54*a* extending in the sheet carrying direction is installed at the sheet dropping position 5*a*. A cam attachment member 54*b* is installed to move along this cam guide 54*a* by an actuator not shown (motor and cylinder etc.), and the opening cam for dropping 54 is attached to this cam attachment member 54*b* by a link 54*c*.

The link 54*c* is swung in the vertical direction with an actuator not shown in the drawings. By swinging the link 54*c* downward, the opening cam for dropping 54 moves to the operating position as shown by a solid line. By swing the link 54*c* upwards, the opening cam for dropping 54 moves to the non-operating position as shown by an imaginary line.

The position in the sheet carrying direction of the opening cam for dropping 54 is adjusted by moving the cam attachment member 54*b* along the cam guide 54*a*.

The opening cam for ejection 53 is attached to the main body frame so as to be able to adjust its position in the carrying direction. For example, this opening cam for ejection 53 is attached to the main body frame by screwing a bolt 53*b* into the main body frame through a slot 53*a* extending in the carrying direction.

A drop auxiliary means 55 to apply a downward force to the sheet 2*b* when dropping the printed sheet 2*b* is installed at the sheet dropping position 5*a*. For example, a plurality of air nozzles 55*a* is arranged at intervals in the carrying direction and the lateral direction so as to spray air on the upper surface of the dropping sheet 2*b*.

A transfer auxiliary means 56 to assist the delivery of the printed sheet 2*b* to the delivery section 6 of is installed at the downstream side in the carrying direction than the sheet dropping position 5*a*. For example, a plurality of the fans 56*a* is arranged at intervals in the lateral direction so as to spray air on the upper surface of the printed sheet 2*b*.

In addition, a plurality of the chains 50 is arranged at intervals in the lateral direction and the transfer auxiliary means 56 is disposed between the chains 50 so as not to interfere with the chain 50 and sprocket 50*a*.

Next, the structure of the sheet carrying section for turnover 7 will be explained in detail based on FIG. 10.

The sheet carrying section for turnover 7 comprises a sheet receiving plate 70, a second suction conveyer 71, a suction roller 72, second feed rollers 73, a side jogger 74 and a stopper 75.

The sheet receiving plate 70 is located closer to the delivery section 6 in the lower part of the sheet dropping position 5*a*.

The second suction conveyer 71 is located closer to the sheet positioning section 3 in the lower part of the sheet dropping position 5*a*, and the second suction conveyer 71 and the sheet receiving plate 70 continue in the sheet carrying direction, and the one side printed sheet 2*b* is dropped onto them. The second suction conveyer 71 has the same structure as that of the first suction conveyer 20 previously explained.

The suction roller 72 is located closer to the downstream side in the sheet carrying direction of the second suction conveyer 71 and is close to the chain 50. The suction roller 72 rotates in the clockwise direction at the speed lower than the carrying speed of the one side printed sheet 2*b* by the chain 50. The suction roller 72 has a form of a cylinder which has a number of holes in the peripheral surface thereof and sucks the sheet 2*b* to the peripheral surface by sucking the air inside thereof and carries the sheet 2*b* by the rotation thereof.

A pair of the second feed rollers 73 is located at the downstream side in the sheet carrying direction of the suction roller 72 and carries the one side printed sheet 2*b* along the sheet guide 76 towards the sheet positioning section 3.

The side jogger 74 moves the sheet receiving plate 70 and the one side printed sheet 2*b* which is dropped onto the second suction conveyer 71 in the lateral direction.

The stopper 75 is located closer to the delivery section 6 and on the sheet receiving plate 70, against which the front end surface of the one side printed sheet 2*b* abuts. This stopper 75 is adjustable its position in the sheet carrying direction.

Then, a carrying operation of the one side printed sheet 2*b* to the sheet positioning section 3 will be explained.

When the one side printed sheet 2*b* which is gripped by the gripper 51 attached to the chain 50 arrives at the position near the sheet dropping position 5*a*, the one side printed sheet 2*b* is subjected to a downward force effected by the air shower from the air nozzles 55*a*, and is suck to the suction roller 72.

Since the suction roller 72 rotates clockwise at the sheet carrying speed lower than the carrying speed of the one side printed sheet 2*b* by the chain 50, that is, at the sheet carrying speed lower than the movement speed of the gripper 51 (clamp for sheet grapping) attached to the chain 50, the one side printed paper 2*b* which arrived at the neighborhood of the sheet dropping position is subjected to a force in the direction opposite to the sheet carrying direction by the suction roller 72 (in other words, braking carriage of the one side printed sheet 2*b* which is carried is applied by the suction roller 72). Because the transfer speed of the one side printed sheet 2*b* is reduced than the movement speed of the gripper 51 attached to the chain 50 when the gripper 51 attached to the chain 50 is opened by the opening cam 54 for dropping in this state, the one side printed sheet 2*b* is easy to drop out from the gripper 51 attached to chain 50.

In addition, the chain 50 and the suction roller 72 are not allowed to contact with each other to prevent the suction roller 72 from becoming an excessive brake for the sheet 2*b* which is not made to drop at the sheet dropping position 5*a*.

In addition, the back end of the one side printed sheet 2*b* (end of the sheet positioning section 3 side) can be dropped faster than the front end of the one side printed sheet 2*b* (end of the delivery section 6 side), because the suction roller 72 sticks the back end of the one side printed sheet 2*b* (end of the sheet positioning section 3 side) which is released and is dropped from the gripper 51 attached to the chain 50 and rotates clockwise to feed it towards the delivery section 6. This achieves the prevention of collision between the one side printed sheet 2*b* which is dropping and the one side printed sheet 2*b* which is conveyed with gripper 51.

Furthermore, an air shower by the air nozzles 55*a* acts on the upper surface of the one side printed sheet 2*b* which is released and dropped from the gripper 51 attached to the chain 50, and thereby affects the one side printed sheet 2*b* with the downward force and assist its drop. In this way, the dropping locus of the one side printed sheet 2*b* can be stabilized.

A fan can be used to affects the upper surface of the one side printed sheet 2*b* with the air shower too, but there are two ways in which the one side printed sheet 2*b* is made to drop or not to drop at the sheet dropping position 5*a* and to this end, there are provided two states in which the air shower is operated or is stopped to operate, therefore the air nozzle is more desirable than the fan.

By these, the sheet 2*b* may be dropped in more stable state than in dropping by the gravity.

In addition, since the front end edge of the one side printed sheet 2*b* dropped from the sheet dropping position 5*a* comes in contact with the stopper 75, the one side printed sheet 2*b* does not be dropped forward from the sheet receiving plate 70 even by the sheet carrying power. The positions in the sheet carrying direction of this stopper 75 and the opening cam 54 for dropping are adjusted depending on the top to bottom size of the sheet.

In addition, when the one side printed sheet 2*b* is on the way of dropping, or on the sheet receiving plate 70 or on the second suction conveyer 71 after dropping, the side jogger 74 is moved in one of the right or left direction only a short distance to move the one side printed sheet 2*b* in one of the right or left direction only the same distance so that the central position in the lateral direction of the one side printed sheet 2*b* is made to coincide with the central position 2*b*-1 in the lateral direction of the sheet 2*b* in the sheet supply section 2.

In other words, the side jogger 74 constitutes a means to move the printed sheet 2*b* which fell in the lateral direction. This is for the operation to move the one side printed sheet 2*b* in the lateral direction to position it in the lateral direction by the inclined suction conveyer 30*b* of the sheet positioning section 3 whom it passes later.

In other words, since the central position in the lateral direction of the one side printed sheet 2*b* fed by the chain 50 is identical with the central position in the lateral direction of the sheet 2*b* positioned in the sheet positioning section 3 and thereby the central position in the lateral direction of the one side printed sheet 2*b* which fell from the sheet dropping position 5*a* is off the central position 2*b*-1 in the lateral direction of the sheet 2*b* in the sheet supply section 2, the one side printed sheet 2*b* which fell from the sheet dropping position 5*a* is made to move in the lateral direction to make its central position in the lateral direction to coincide with the central position 2*b*-1 in the lateral direction of the sheet 2*b* in the sheet supply section 2.

The one side printed sheet 2*b* dropped is intermittently carried by the second suction conveyer 71. The second suction conveyer 71 is at a standstill=when the one side printed sheet 2*b* drops.

Therefore, the top and bottom register of the one side printed sheet 2*b* is stable as compared with that of the sheet 2*b* dropping on a conveyer during driving like in the printer disclosed in JP 2015-11178 A.

The start timing of driving of the second suction conveyer 71 is determined by the signal from the proximity sensor installed opposite to the gear which rotationally drives the transfer roller 40 as with the suction conveyer 20.

When the second suction conveyer 71 is driven, the one side printed sheet 2*b* is carried to the pair of the second feed rollers 73 which rotates at a constant speed.

And, the one side printed sheet 2*b* is carried by the second feed rollers 73 and is carried to the suction conveyers 30*a*, 30*b* of the sheet positioning section 3. Here, a structure is provided that the non-printed sheet 2*b* carried from the sheet supply section 2 and the one side printed sheet 2*b* carried from the second suction conveyer 71 are alternately carried to the sheet positioning section 3. According to this structure, the print of the front surface (one side) and print of the back surface (the other side) are alternately performed in the electro-photographic printing section 4.

In addition, for example, the sheet carrying speed of the pair of the feed rollers 73 is the same as the sheet carrying speed of the backup roller 41 and is prevented from varying from the sheet carrying speed of the backup roller 41.

In this embodiment, the one side printed sheet 2*b* is made to drop on the second suction conveyer 71 which is at a standstill and the non-printed sheet 2*b* carried from the sheet supply section 2 and the one side printed sheet 2*b* carried from the second suction conveyer 71 are alternately carried to the sheet positioning section 3 to enable the alternating print of the front and back surfaces thereof.

In the printer disclosed in JP 2015-11178 A, in order to perform an alternative printing, it is necessary to make the one side printed sheet drop between the non-printed sheets being carried over the conveyer. However, making the one side printed sheet drop on an aimed position on the conveyer while carrying the non-printed sheet is easily resulted in a positional displacement of the one side printed sheet with respect to the aimed position on the conveyer.

In addition, since it is difficult to stop dropping one side printed sheet without its slipping on the conveyer, there is a fear that the dropping one side printed sheet collides with and is piled up on the non-printed carried sheet, if an interval of the non-printed carried sheets is small.

Therefore, the carrying sheet interval must be made wide to eliminate the possibility of this fear, which results in the deterioration of the print efficiency.

With respect to the positional displacement mentioned above, since the dropping sheet is unstable and it is thereby difficult to control it, and then a time needed for a drop of the one side printed sheet does not vary basically, even if the carrying speed of the non-printed sheet changes, it is difficult to make the one side printed sheet drop to the aimed position on a conveyer while carrying the non-printed sheet.

The one side printed sheet 2*b* carried to the sheet positioning section 3 is transferred to the clamp 41*a* of the backup roller 41 as with the front surface printing, and the back surface thereof is printed by electro-photographic printing section 4.

In this embodiment, the diameter of the transfer roller 40 is twice the diameter of the backup roller 41, and quadruple of the diameter of the photoconductor drum 42*a*, and four transferred images (toner images) are formed on the peripheral surface of the transfer roller 40. Therefore, when the front and back surface printing are alternately carried out, the toner image of the same surface (in other words, the front surface or the back surface) is always formed on the surface layer of rubber material of the certain jacket 40*b* on the surface of the transfer roller 40.

In the wet type electro-photographic developing device, if cleaning of the transfer roller 40 with the cleaning unit 43 is insufficient, it may cause a fear that a phenomenon of reflection of previous toner image to a present toner image occurs, but such a phenomenon is inconspicuous because they are always the toner images on the same surface in this embodiment.

In other words, since a toner image for one side to be printed on the one side of the sheet 2*b* and a toner image for other side to be printed on the other side of the sheet 2*b* are alternately and circumferentially formed on even numbers of parts of the peripheral surface of the transfer roller 40, and thus the toner image for one side and the toner image for other side are always on the same parts of the peripheral surface of the transfer roller 40, respectively, the toner image for other side is not formed on the part on which the toner image for one side is formed.

In this way, even in cases where cleaning of transcription roller 40 is insufficient and the reflection of the toner image occurs, the reflection is inconspicuous.

An outline of the duplex printing operation of this embodiment will be explained based on FIGS. 11 and 12.

In addition, on account of the explanation, in the following explanation, the sheet 2*b* is explained with being classified and referred to as non-printed sheet 2*b* (W), one side printed sheet 2*b* (P1) and both side printed sheet 2*b* (P2) by using other references.

Figure 11:
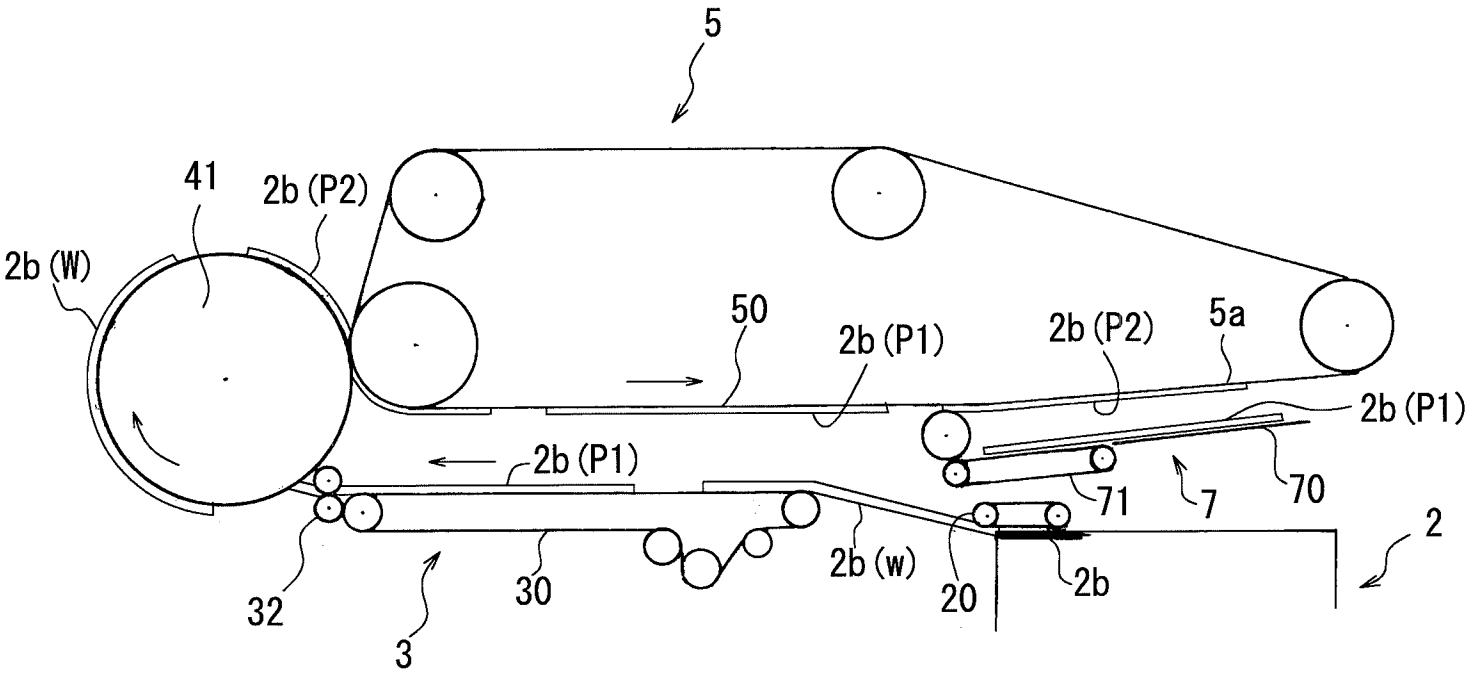
FIG. 11 is an explanatory view of a sheet carriage at the time of a duplex printing.

As shown in FIG. 11, when the non-printed sheet 2*b* (W) is carried to the sheet positioning section 3 from the sheet supply section 2, the sheet positioning section 3 positions the one side printed sheet 2*b* (P1) and sends out it to the backup roller 41. At this time, the sheet carrying section for turnover 7 is at a standstill. With the backup roller 41, the one side of the non-printed sheet 2*b* (W) is printed and the both side printed sheet 2*b* (P2) of which the both sides have been printed is sent into the chain delivery section 5.

The chain delivery section 5 carries one piece of the both side printed sheet 2*b* (P2) and one piece of the one side printed sheet 2*b* (P1). The sheet carrying section for turnover 7 waits for sending out while supporting one piece of the one side printed sheet 2*b* (P1). This state is changed to the state as shown in FIG. 12 because each of the sections carries the sheets 2*b* (W), 2*b* (P1) and 2*b* (P2).

Figure 12:
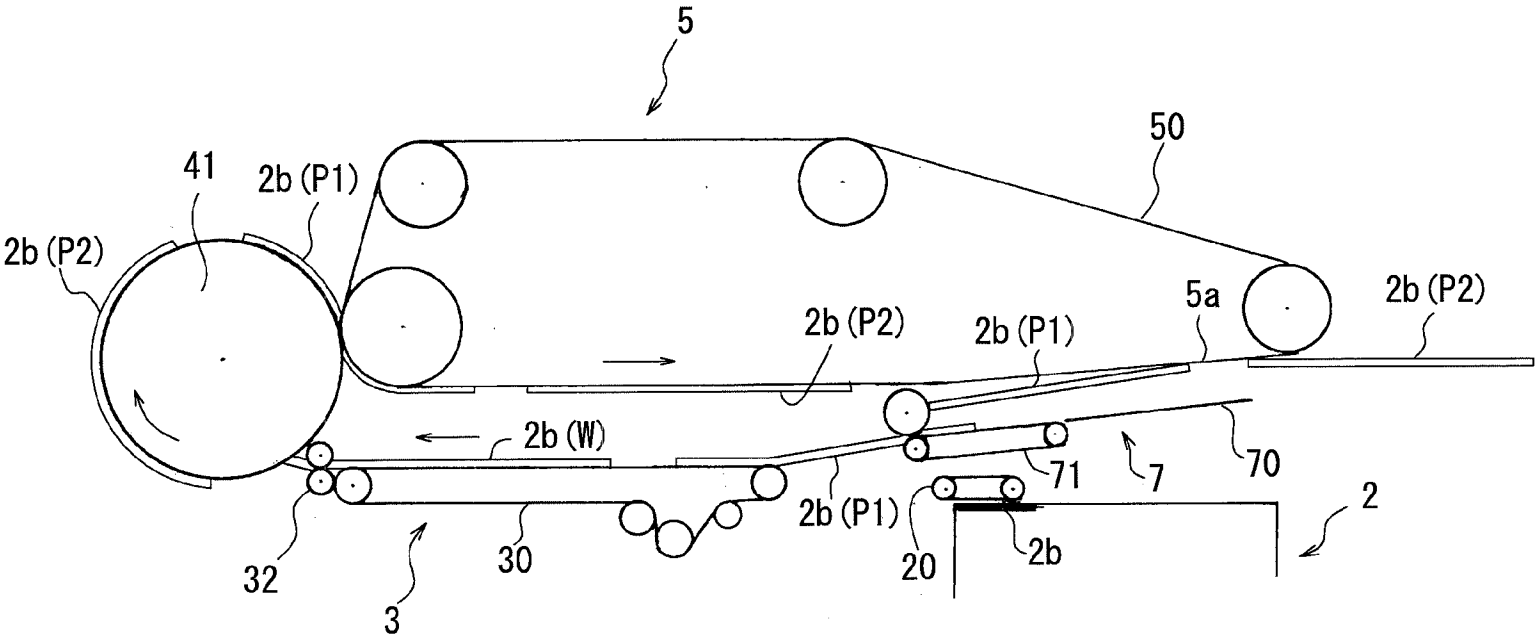
FIG. 12 is an explanatory view of a sheet carriage at the time of the duplex printing.

The state as shown in FIG. 12, the sheet supply section 2 is a standstill and does not carry the non-printed sheet 2*b* (W), but the one side printed sheet 2*b* (P1) is sent into the sheet positioning section 3 from the sheet carrying section for turnover 7. The sheet positioning section 3 sends out the non-printed sheet 2*b* (W) to the backup roller 41. With the backup roller 41, the one side printed sheet 2*b* (P1) is printed on its other side to make a double side printed sheet 2*b* (P2) and the one side printed sheet 2*b* (P1) is sent out to the chain delivery section 5.

In the chain delivery section 5, one piece of the both side printed sheet 2*b* (P2) is carried and one piece of the one side printed sheet 2*b* (P1) is dropped on the sheet carrying section for turnover 7 and one piece of the both side printed sheet 2*b* (P2) is carried to the delivery section 6.

Figure 13:
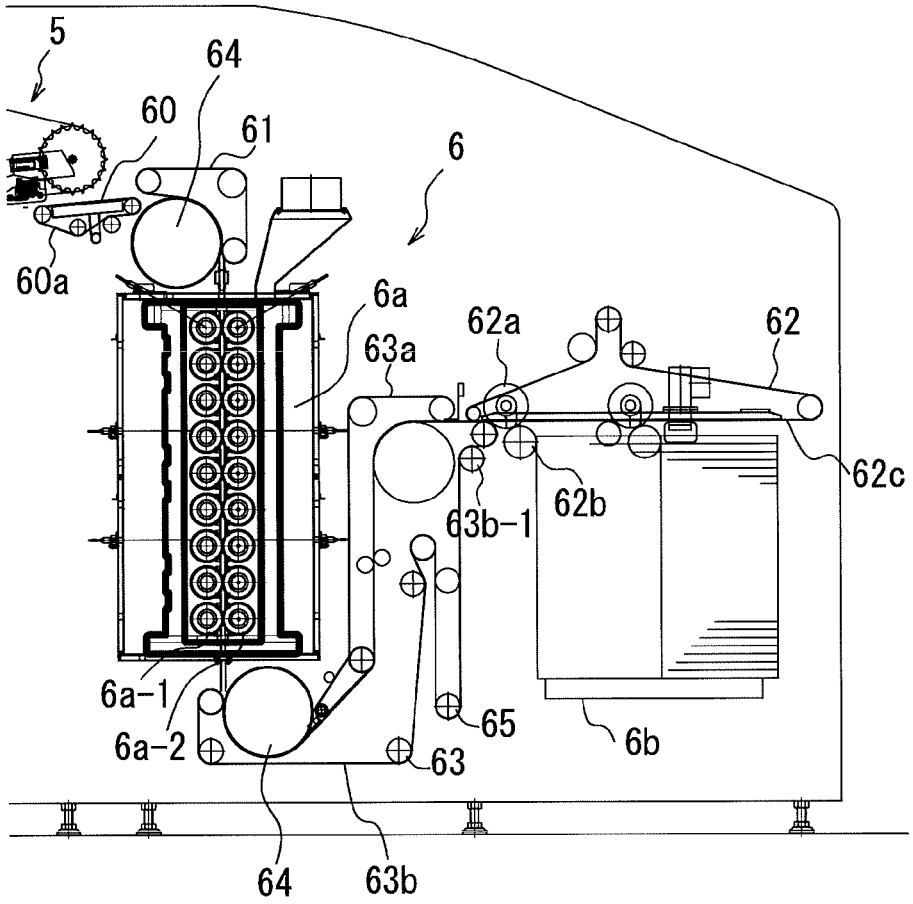
FIG. 13 is a front view that illustrates a structure of the chain delivery section.

Then, the structure of the delivery section 6 with its operation will be explained in detail based on FIG. 13.

The delivery section 6 comprises a suction conveyer 60 for ejection installed below a ejection position of the chain delivery section 5, a first carrying conveyer 61 installed between the suction conveyer 60 for ejection and an entrance side of the fixing device 6*a* and a second carrying conveyer 63 installed between an exit side of the fixing device 6*a* and a stacker 62. The ejection position is the position where the gripper 51 is made to open by the opening cam for ejection 53 and the printed sheet (one side printed sheet 2*b* (P1) in the case of the one side printing, both side printed sheet 2*b* (P2)) in the case of the duplex printing) is dropped.

When the printed sheet 2*b* (P1) or 2*b* (P2) on which printing was completed is ejected into the delivery section 6, the opening cam for dropping 54 of the chain delivery section 5 is moved to the non-operating position and thus gripper 51 is not opened to prevent the printed sheet 2*b* (P1) or 2*b* (P2) from dropping at the sheet dropping position 5*a*. Thereafter, the gripper 51 is opened by the opening cam for ejection 53 to allow the printed sheet 2*b* (P1) or 2*b* (P2) to drop on the suction conveyer 60 for ejection.

In addition, in the case of this embodiment, a fan 56*a* is installed above the chain 50 at the ejection position, where the printed sheet 2*b* (P1) or 2*b* (P2) is allowed to drop on by the opening cam for ejection 53.

And, an air shower by the fan 56*a* acts on the upper surface of the printed sheet 2*b* (P1) or 2*b* (P2) to stabilize the dropping locus of the printed sheet 2*b* (P1) or 2*b* (P2) which is allowed to drop by opening of the gripper 51 of the chain 50 at the ejection position.

Since the both side printed sheet 2*b* (P2) and the one side printed sheet 2*b* (P1) are alternately carried in the duplex printing as described above, the dropping one side printed sheet 2*b* (P1) and the both end printed sheet 2*b* (P2) sent to the delivery section 6 are alternately carried at the sheet dropping position 5*a* of the chain delivery section 5.

Therefore, the opening cam for dropping 54 repeats its movement from the operating position to the non-operating position for every other sheet. The air nozzle 55*a* repeats an air shower (an ejection and stop of the air) in regular intervals.

In addition, in the duplex printing, only the both side printed sheet 2*b* (P2) to be carried to the delivery section 6 is carried to the ejection position where the sheet is allowed to drop by the opening cam for ejection 53. And, the fan 56*a* always operates to make an air shower act because the opening cam for ejection 53 is fixed.

The suction conveyer for ejection 60 sucks out air from a number of holes made in the belt 60*a* to make the printed sheet 2*b* (P1) or 2*b* (P2) stuck to the belt 60*a* and carries while sucking them to the belt 60*a*. The printed sheet 2*b* (P1) or 2*b* (P2) is sent into the fixing device 6*a* by the first carrying conveyer 61. The toner image is completely fixed on the printed sheet 2*b* (P1) or 2*b* (P2) where the printed sheet 2*b* (P1) or 2*b* (P2) passes through the fixing device 6*a*.

The fixing device 6*a* comprises a number of the fixing roller pairs which each is composed of a fixing roller 6*a*-1 having a heater inside and a fixing roller 6*a*-2 having a heater inside which make a pair, so as to contact with the front and back surfaces of the printed sheet 2*b* (P1) or 2*b* (P2), and the toner images on the front surface or the back surface or the front and back surfaces are fixed at the same time where the printed sheet 2*b* (P1) or 2*b* (P2) passes through between these fixing roller pairs.

In this embodiment, each of the fixing rollers 6*a*-1, 6*a*-2 has the heater of the short wavelength in its center and performs fixing by heat of the heater. Generally, the temperature of the fixing device decreases when the printed sheet 2*b* (P1) or 2*b* (P2) passes through the fixing device, because the heat is absorbed by the printed sheet 2*b* (P1) or 2*b* (P2). Therefore, a difference in degree of fixing is caused, because the temperature in the fixing device varies according to the interval of passing of the printed sheet 2*b* (P1) or 2*b* (P2) through the fixing device. However, in this embodiment, the printed sheet 2*b* (P1) or 2*b* (P2) passes through the fixing device 6*a* at regular intervals by printing the one side and the other side alternately, therefore fixing can be performed at a constant temperature.

In addition, cooling rollers 64 are installed at the entrance side (the upstream side) and the exit side (the downstream side) of the fixing device 6*a*, respectively, but these rollers may be usual rollers.

The printed sheet 2*b* (P1) or 2*b* (P2) having passed through the fixing device 6*a* is clamped by a pair of upper and lower carrying conveyers 63*a*, 63*b* of the second carrying conveyer 63 and carried up to a front side of=the upper part of the elevating table 6*b*.

Because a dancer roller 65 is installed in the lower carrying conveyer 63*b*, a roller 63*b*-1 at the downstream edge of the lower carrying conveyer 63*b* is movable together with a duster 62*a* and a suction roller 62*b* of the stacker 62 from the front side (the fixing device 6*a* side) to the midpoint as shown by the imaginary line above the elevating table 6*b* according to the top to bottom size of the printed sheet 2*b* (P1) or 2*b* (P2). By these, the printed sheet 2*b* (P1) or 2*b* (P2) is supported from the underside and carried. In other words, the back side of the elevating table 6*b* (the side opposite to the fixing device 6*a*) is a reference position where the printed sheet 2*b* (P1) or 2*b* (P2) is piled up.

Furthermore, a suction conveyer 62*c* is installed at the downstream side of the upper carrying conveyer 63*a* on much the same level therewith. This suction conveyer 62*c* assists that the front end edge in the carrying direction of the printed sheet 2*b* (P1) or 2*b* (P2) arrives at the reference position of the back side of the elevating table 6*b* particularly in cases of the printed sheet 2*b* (P1) or 2*b* (P2) when it is thin.

The suction conveyer 62*c* continuously attracts the printed sheet 2*b* (P1) or 2*b* (P2) by suction power of the degree not to disturb a drop thereof and makes the front end edge in the carrying direction of the printed sheet 2*b* (P1) or 2*b* (P2) arrive at the reference position (stopper not shown) in the back side of the elevating table 6*b*.

The front end edge in the carrying direction of the printed sheet 2*b* (P1) or 2*b* (P2) carried in this way arrives at the reference position, and then the printed sheet 2*b* (P1) or 2*b* (P2) is dropped on the elevating table 6*b*. However, there is a fear that the printed sheet 2*b* (P1) or 2*b* (P2) might collide with the following printed sheet 2*b* (P1) or 2*b* (P2), if this drop process requires an amount of time.

For this reason, the back side (the rear end side in the carrying direction) of the printed sheet 2*b* (P1) or 2*b* (P2) is made to drop quickly by swatting the back side of the printed sheet 2*b* (P1) or 2*b* (P2) from above with the duster 62*a* and attracts the printed sheet 2*b* (P1) or 2*b* (P2) from the underside by the suction roller 62*b* when making it drop.

In addition, the one side printing with the duplex printing machine of this embodiment will be explained.

In other words, when the one side printing is performed, the chain delivery section 5 is always set in the first state to successively send the printed sheet 2*b* (P1) to the delivery section 6. The machine is made into the state that the turnover carrying section 7 comes to a stop and the suction roller 72 does not attract the printed sheet.

And, the sheet supply section 2 is continuously driven to successively send the non-printed sheet 2*b* (W) to the sheet positioning section 3.

The non-printed sheet 2*b* (W) sent to the sheet positioning section 3 is positioned as with a duplex printing, and the non-printed sheet 2*b* (W) positioned is sent to the electro-photographic printing section 4. In the electro-photographic printing section 4, the one side of the non-printed sheet 2*b* (W) sent is printed and the printed sheet 2*b* (P1) which one side is printed is transferred to the chain delivery section 5.

In the chain delivery section 5, the one side printed sheet 2*b* (P1) is successively carried to the delivery section 6 by opening the gripper 51 with the opening cam for ejection 53. At this time, the opening cam for dropping 54 is at the non-operating position and thus does not open the gripper 51. Because the suction roller 72 stops its drive and thus does not attract the sheet carried with the chain delivery section 5, the one side printed sheet 2*b* (P1) is smoothly carried.

The toner image on the one side printed sheet 2*b* (P1) sent to the delivery section 6 is fixed by the fixing device 6*a* as with a duplex printing and thereafter the one side printed sheet 2*b* (P1) is loaded on the elevating table 6.

The one side printed sheet 2*b* (P1) is continuously produced from the non-printed sheet 2*b* (W) by performing this operation in succession.

Figure 14:
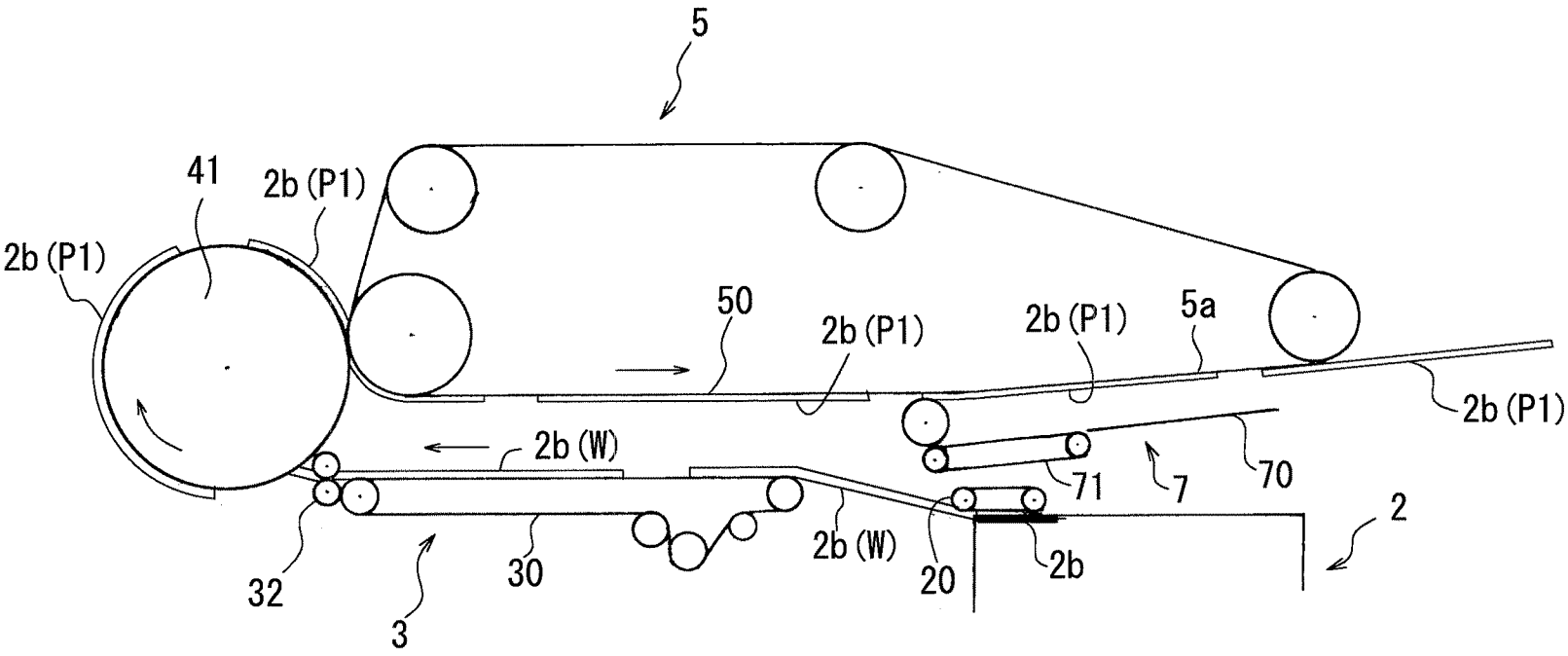
FIG. 14 is an explanatory view of a sheet carriage at the time of a one side printing.

The carrying state of the sheet at this time is as shown in FIG. 14.

What is claimed is:

1. An electro-photographic sheet of paper duplex printing machine having a sheet supply section, a sheet positioning section, an electro-photographic printing section, a chain delivery section and a delivery section arranged in order from upstream to downstream in a direction of carriage of sheets of paper, and having a sheet carrying section for turnover disposed above the sheet supply, wherein the sheet supply section sends out sheets one by one onto the sheet positioning section, the sheet positioning section positions the sheets and sends out positioned sheets to a backup roller in the electro-photographic printing section, the electro-photographic printing section prints a toner image on a sheet transferred onto the transfer roller onto the sheet on the backup roller by transferring the toner image, the chain delivery section selectively transfers printed sheets transferred from the backup roller to the delivery section or the sheet carrying section for turnover, the delivery section has a fixing device for fixing the toner image, the sheet carrying section for turnover is supplied with one side printed sheet dropped from the chain delivery section, and supplies the one side printed sheet to the sheet positioning section by a suction conveyer which is intermittently driven, and the sheet fed from the sheet supply section and the one side printed sheet carried from the sheet carrying section for turnover are alternately carried to the sheet positioning section, and the printed sheet passes through the fixing device in the delivery section at regular intervals.

2. An electro-photographic sheet of paper duplex printing machine as set forth in claim 1, wherein the sheet positioning section has a suction conveyer carrying the sheet at a constant speed and a pair of upper and lower registration rollers, the backup roller has a sheet support, the sheet horizontally carried by the suction conveyer in the sheet positioning section horizontally enters the pair of upper and lower registration rollers and comes to a stop when coming in contact with the contact portions of the pair of upper and lower registration rollers, and the sheet is carried to the sheet support of the backup roller by the rotation of the pair of upper and lower registration rollers.

3. An electro-photographic sheet of paper duplex printing machine as set forth in claim 1, wherein the suction conveyer in the sheet positioning section comprises a straight suction conveyer which is located in parallel to the carrying direction of the sheet sent out from the sheet supply section and an inclined suction conveyer which is located at an inclination with respect to the carrying direction of the sheet, and air suction power of the inclined suction conveyer is stronger than air suction power of the straight suction conveyer.

4. An electro-photographic sheet of paper duplex printing machine as set forth in claim 2, wherein the suction conveyer in the sheet positioning section comprises a straight suction conveyer which is located in parallel to the carrying direction of the sheet sent out from the sheet supply section and an inclined suction conveyer which is located at an inclination with respect to the carrying direction of the sheet, and air suction power of the inclined suction conveyer is stronger than air suction power of the straight suction conveyer.

5. An electro-photographic sheet of paper duplex printing machine as set forth in claim 1, wherein a drop auxiliary means to apply a downward force to the sheet when making the sheet drop is installed at the sheet dropping position where the sheet is dropped from the chain delivery section to the sheet carrying section for turnover, and the sheet carrying section for turnover has a means to move the printed sheet in the direction orthogonal to the carrying direction.

6. An electro-photographic sheet of paper duplex printing machine as set forth in claim 2, wherein a drop auxiliary means to apply a downward force to the sheet when making the sheet drop is installed at the sheet dropping position where the sheet is dropped from the chain delivery section to the sheet carrying section for turnover, and the sheet carrying section for turnover has a means to move the printed sheet in the direction orthogonal to the carrying direction.

7. An electro-photographic sheet of paper duplex printing machine as set forth in claim 3, wherein a drop auxiliary means to apply a downward force to the sheet when making the sheet drop is installed at the sheet dropping position where the sheet is dropped from the chain delivery section to the sheet carrying section for turnover, and the sheet carrying section for turnover has a means to move the printed sheet in the direction orthogonal to the carrying direction.

8. An electro-photographic sheet of paper duplex printing machine as set forth in claim 4, wherein a drop auxiliary means to apply a downward force to the sheet when making the sheet drop is installed at the sheet dropping position where the sheet is dropped from the chain delivery section to the sheet carrying section for turnover, and the sheet carrying section for turnover has a means to move the printed sheet in the direction orthogonal to the carrying direction.

* * * * *